US009265299B2

(12) United States Patent
Smith, III

(10) Patent No.: US 9,265,299 B2
(45) Date of Patent: Feb. 23, 2016

(54) INTERNALLY ILLUMINATED FOOTWEAR COMPONENT

(71) Applicant: Roy Robert Smith, III, Sugar Land, TX (US)

(72) Inventor: Roy Robert Smith, III, Sugar Land, TX (US)

( * ) Notice: Subject to any disclaimer, the term of this patent is extended or adjusted under 35 U.S.C. 154(b) by 0 days.

(21) Appl. No.: 14/639,821

(22) Filed: Mar. 5, 2015

(65) Prior Publication Data

US 2015/0181973 A1 Jul. 2, 2015

Related U.S. Application Data

(60) Continuation of application No. 14/268,789, filed on May 2, 2014, now Pat. No. 9,015,965, which is a division of application No. 13/688,745, filed on Nov. 29, 2012, now Pat. No. 8,752,310.

(51) Int. Cl.

| | |
|---|---|
| ***A43B 23/00*** | (2006.01) |
| ***A43B 21/28*** | (2006.01) |
| ***A43B 3/00*** | (2006.01) |
| ***A43B 1/00*** | (2006.01) |
| ***A43B 13/00*** | (2006.01) |

(52) U.S. Cl.

CPC ..... *A43B 3/001* (2013.01); *A43B 1/0027* (2013.01); *A43B 1/0036* (2013.01); *A43B 1/0072* (2013.01); *A43B 3/0078* (2013.01); *A43B 13/00* (2013.01)

(58) Field of Classification Search

CPC .. A43B 1/0027; A43B 1/0072; A43B 1/0036; A43B 3/001; A43B 3/0078; A43B 3/0015

USPC ..... 36/137

See application file for complete search history.

(56) References Cited

U.S. PATENT DOCUMENTS

| | | | | |
|---|---|---|---|---|
| 4,712,314 | A * | 12/1987 | Sigoloff | 36/112 |
| 5,303,485 | A * | 4/1994 | Goldston et al. | 36/137 |
| 5,822,885 | A * | 10/1998 | Loverin | 36/25 R |
| 7,841,108 | B2 * | 11/2010 | Johnson et al. | 36/136 |
| 7,937,856 | B2 * | 5/2011 | Cook et al. | 36/137 |
| 8,356,430 | B2 * | 1/2013 | Beers | 36/137 |
| 2008/0019119 | A1 * | 1/2008 | Marston | 362/103 |
| 2012/0260532 | A1 * | 10/2012 | Catalano | 36/103 |
| 2013/0213145 | A1 * | 8/2013 | Owings et al. | 73/862.046 |

* cited by examiner

*Primary Examiner* — Jila M Mohandesi

(57) ABSTRACT

The sole section of a shoe includes a midsole and an outsole which form a translucent sole section. The translucent midsole and translucent outsole are integrally molded with a translucent upper to create a fully translucent jelly footwear. An illumination system is located inside the translucent sole section, causing the jelly footwear to be internally illuminated when the illumination system is active. Due to the translucent nature of the midsole light from the illumination system reflects internally throughout the midsole, increasing illumination. The light will also illuminate the adjacent translucent outsole and translucent upper. Light from the illumination system can be blocked, such as by a colored mold injection, creating an illuminated design or logo. By blacking out or covering sections of the translucent outsole, shapes and letters of visible light can be created in the resulting negative space. This allows illuminated designs to easily be incorporated into footwear.

6 Claims, 34 Drawing Sheets

INTERNALLY ILLUMINATED FOOTWEAR COMPONENT

CROSS-REFERENCE TO RELATED APPLICATION

The current application is a continuation of U.S. Utility patent application Ser. No. 14/268,789 filed on May 2, 2014 which is a division of the U.S. Utility patent application Ser. No. 13/688,745 filed on Nov. 29, 2012.

FIELD OF THE INVENTION

The present invention relates generally to a footwear component with an internal illumination system and means of displaying graphics and designs by selectively covering light from the internal illumination system.

BACKGROUND OF THE INVENTION

Using light as an accessory to footwear is commonly employed and has been for some time. Shoes, sneakers or otherwise, have been given various arrangements of lighting systems to enhance visual appeal of the shoe, especially towards children. Often times the lights are external to the shoe, and serve as an accessory rather than an integral part of the shoe, simply lighting up the outside areas of the shoe. Generally, the lights do not internally illuminate the shoe, instead providing illumination external to the shoe.

While there are examples of footwear with internal lighting systems, current methods of lighting a shoe can still use improvement. Some solutions simply place a few lighting elements inside the shoe, perhaps in a transparent compartment. While certainly internal to the shoe, these lighting elements don't really provide internal illumination. Some products hollow out sections of shoes, where lights are placed. Sometimes these hollowed sections have components inside, which are illuminated by the lights. Other times the sections are empty, showing light along the internal walls. These examples provide some measure of internal illumination, but leave much to be desired. Generally, only small portions of the shoe are illuminated, and even then, the shoe itself is not illuminated so much as are various components and internal surfaces which are located in the illuminated section.

It is therefore an object of the present invention to provide an internally illuminated component for a shoe. It is a further object of the present invention, to provide a method of obstructing the internal illumination, to create visual designs along the external surface, of the internally illuminated component.

DETAIL DESCRIPTIONS OF THE INVENTION

Figure 1:
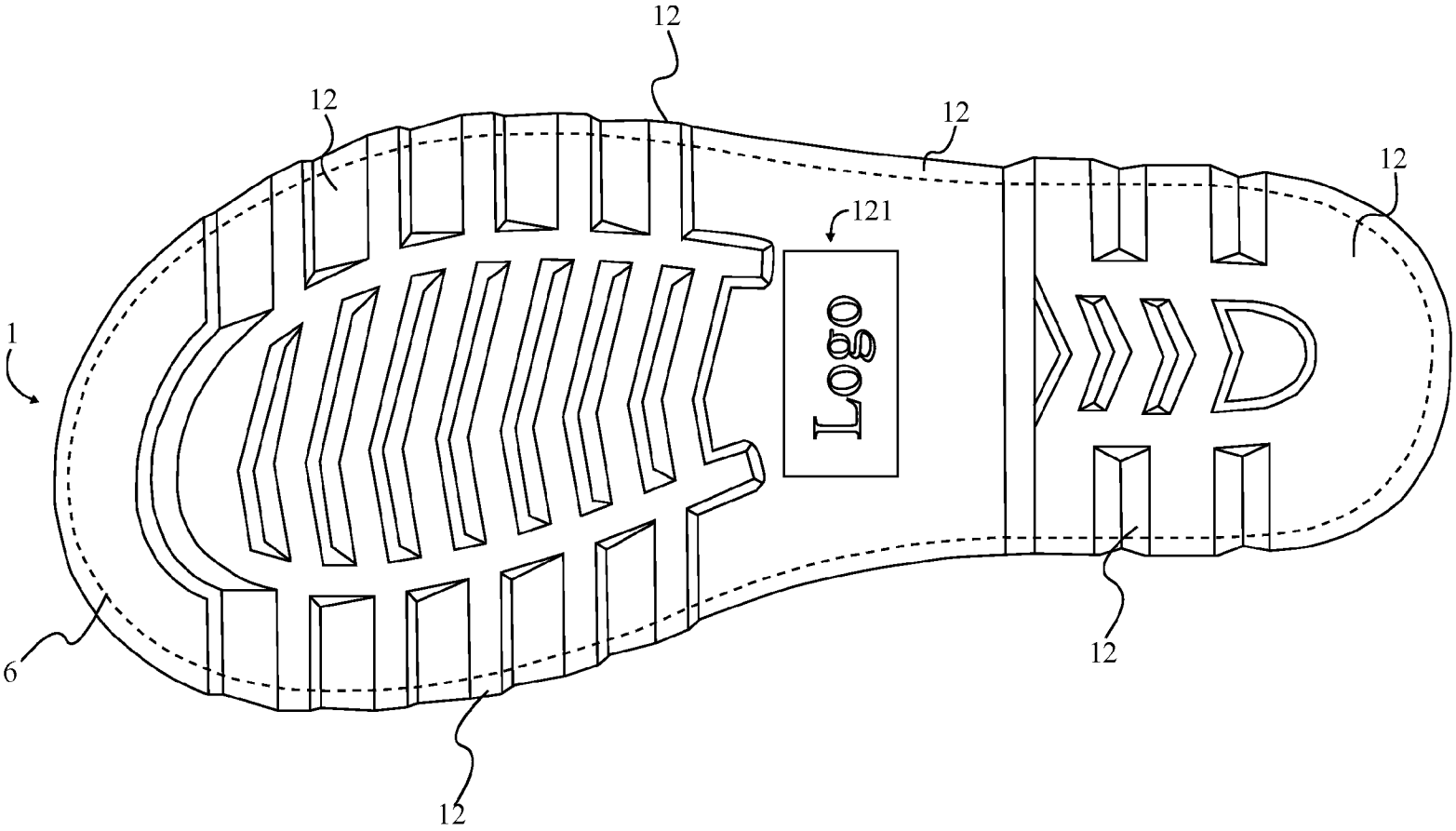
FIG. 1 is a bottom view of one embodiment of the present invention, showing a sole section with a translucent midsole and outsole being separately molded.
Figure 2:
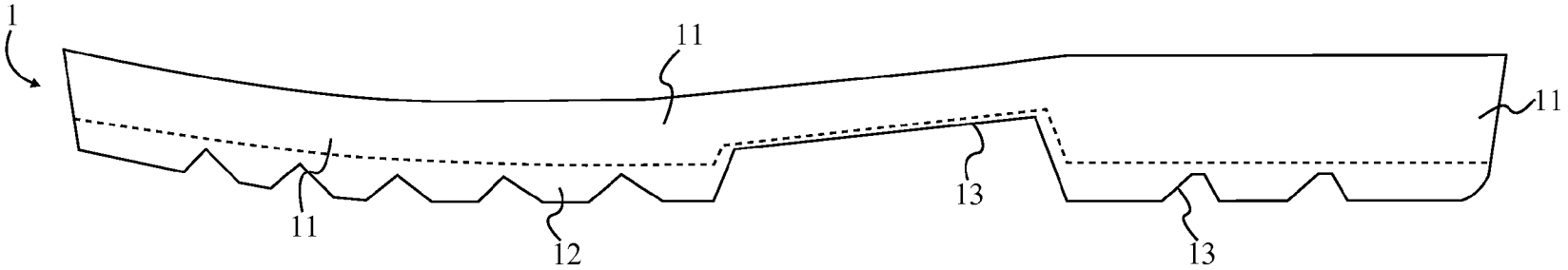
FIG. 2 is a side view of one embodiment of the present invention, showing the sole section with the translucent midsole and outsole being separately molded.

All illustrations of the drawings are for the purpose of describing selected versions of the present invention and are not intended to limit the scope of the present invention.

An internally illuminated footwear component comprises a sole section 1, an illumination system 2, and an illumination housing 3, shown in FIG. 1, FIG. 2, FIG. 3, and FIG. 4, FIG. 5, FIG. 6, and FIG. 8. The illumination housing 3 is located within the midsole area and is designed to receive the illumination system 2. Since the illumination system 2 is placed internally within the midsole area, the resulting footwear component is internally illuminated. Several embodiments of the present invention are possible. Each embodiment comprises the sole section 1, the illumination system 2, and the illumination housing 3. The sole section 1 comprises a translucent midsole 11 and an outsole 12, with the outsole 12 further comprising a plurality of outsole design sections 121. Variations in configurations, components, and construction result in the possible embodiments.

The translucent midsole 11 and outsole 12 of the sole section 1 are positioned in a midsole area and an outsole area. The translucent midsole 11 is positioned atop the outsole 12 and connected to the outsole 12, the combination of which forms the sole section 1. In one embodiment, the translucent midsole 11 and the outsole 12 are manufactured independent from one another and then later connected to form the sole section 1. For example, if using injection molding the translucent midsole 11 and the outsole 12 are separately molded pieces and require the translucent midsole 11 to be connected to the outsole 12 in order to form the sole section 1. In an alternative embodiment, the translucent midsole 11 and outsole 12 are manufactured as a single piece, being integrally molded to form the sole section 1.

When produced together, the translucent midsole 11 and outsole 12 provide a singularly molded translucent sole section 14 suitable for use in a number of footwear constructions. The sole section 1 in this embodiment is a solid unit as a result of the molding process. One example of said single piece alternative embodiment is a singularly molded translucent footwear 4 or "jelly" type shoe, illustrated in FIG. 9, FIG. 10, and FIG. 11 and hereafter referred to as a shoe jelly. In this shoe jelly the entire footwear is preferably translucent; thus the outsole 12 is translucent. Also necessary for the translucent footwear is a translucent upper 41, the translucent upper 41 being integrally molded along with the translucent midsole 11 and the outsole 12. The result is a singularly molded translucent footwear 4, as exemplified by the shoe jelly illustrated in FIG. 9, FIG. 10, and FIG. 11. The illumination sources 23 creates light that travels through the translucent midsole 11, outsole 12, and a translucent upper 41, resulting in 100% of the shoe jelly being internally illuminated.

Figure 5:
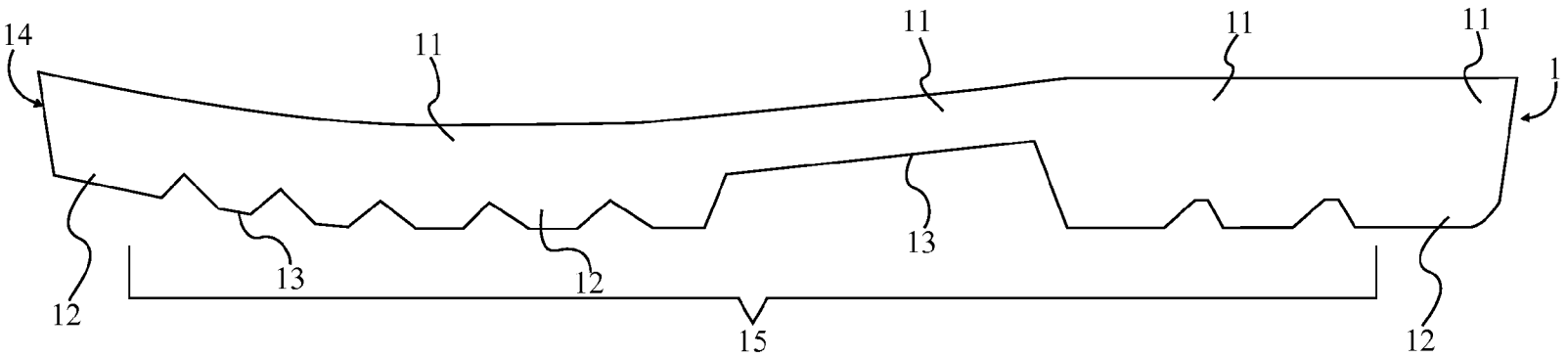
FIG. 5 is a side view of an alternative embodiment of the present invention, showing a singularly molded translucent sole section.
Figure 6:
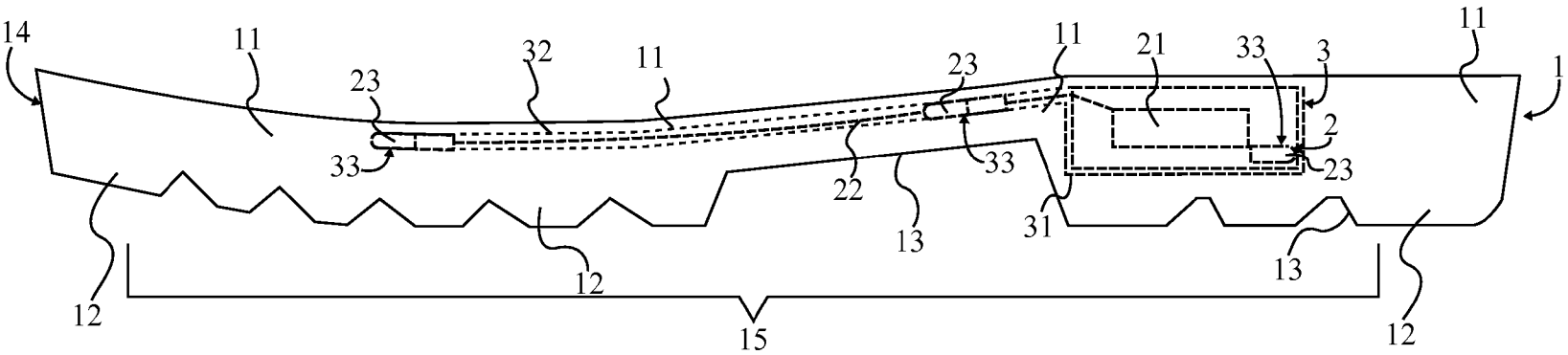
FIG. 6 is a side internal view of the alternative embodiment of the present invention, showing the singularly molded translucent sole section.

Another example of an embodiment with a singularly molded translucent sole section 14 is illustrated in FIG. 5 and FIG. 6, which can be compared to an embodiment with a separately molded translucent midsole 11 and outsole 12 as illustrated in FIG. 1, FIG. 2, FIG. 3, and FIG. 4. The embodiment with a singularly molded translucent sole section 14 can be used in combination with any style of upper; in a further example a waterproof upper is connected to the singularly molded translucent sole section 14 to create a rain boot footwear. However, it is preferred that the rain boot footwear is singularly molded as one piece similar to the previously described shoe jelly; an upper 41 is molded together with the singularly molded translucent sole section 14. An example of said rain boot footwear is provided in FIG. 7. The molding process is such that this upper 41 can be translucent or opaque. Preferably, this rain boot footwear also has a tread pattern 15 being formed through a specific configuration of the plurality of outsole design sections 121. Multicolor molding can be used to create a sole section 1, translucent midsole 11, or outsole 12 with different materials and properties. For example, if the translucent midsole 11 and outsole 12 are integrally molded to form the sole section 1, multicolor molding can be used to make the outsole 12 opaque rather than translucent. Multicolor molding is especially advantageous with certain embodiments and variants of the present invention, as later introduced and described.

Figure 7:
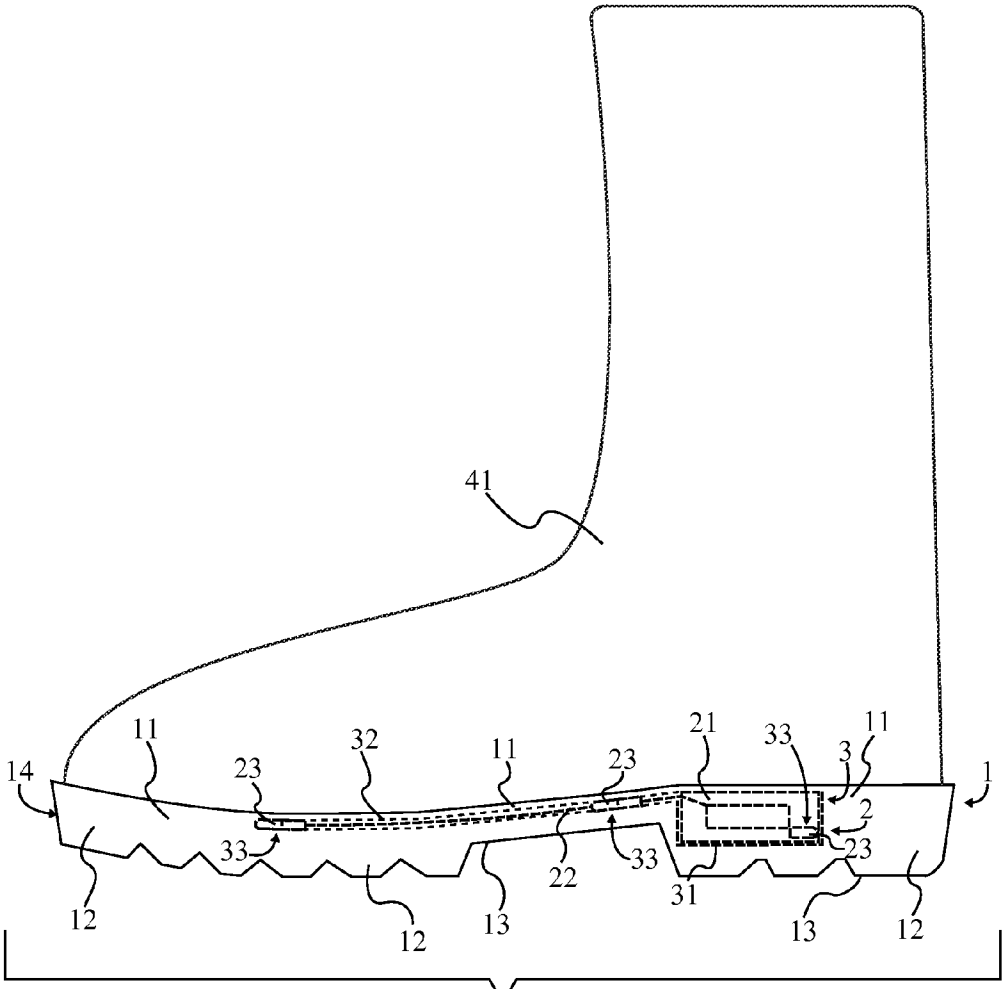
FIG. 7 is a side internal view of the alternative embodiment of the present invention, showing a singularly molded upper and sole section.

The translucent midsole 11, which includes the illumination housing 3 as illustrated in FIG. 3, FIG. 4, FIG. 6, and FIG. 7, is positioned above the outsole 12. The outsole 12 is preferably of a unitary construction which itself comprises a tread pattern 15 along a bottom surface 13. Potentially, the plurality of outsole design sections 121 may be configured to form the tread pattern 15; this is shown in FIG. 5, FIG. 6, and FIG. 7 as part of an embodiment with a singularly molded translucent sole section 14. As previously referenced, the described tread pattern 15 preferably utilized with a rain boot footwear but is ultimately suitable for use with any style of footwear. Atop the sole section 1, positioned around the perimeter of the translucent midsole 11, is a welt 6 as shown in FIG. 1 that forms a wall around the translucent midsole 11. This welt 6 is also known as a lip, and is common to many footwear designs. The welt 6 is also translucent and thus illuminates in the manner of the translucent midsole 11.

The sole section 1 as a whole is essential to the present invention, facilitating the illuminative aspect and the addition of the plurality of outsole design sections 121. The sole section 1 is applicable to various types of footwear designs, providing both the required internal support and external hardiness needed for the common footwear. The light-permeable nature of the translucent midsole 11 allows the translucent midsole 11 to be internally illuminated by the illumination system 2, which is installed in the illumination housing 3 located internally within the translucent midsole 11. As a result of the translucent midsole 11, the light from the illumination system 2 travels throughout the translucent midsole 11 and translucent outsole 12 and provides a visually appealing internally illuminated display.

Figure 3:
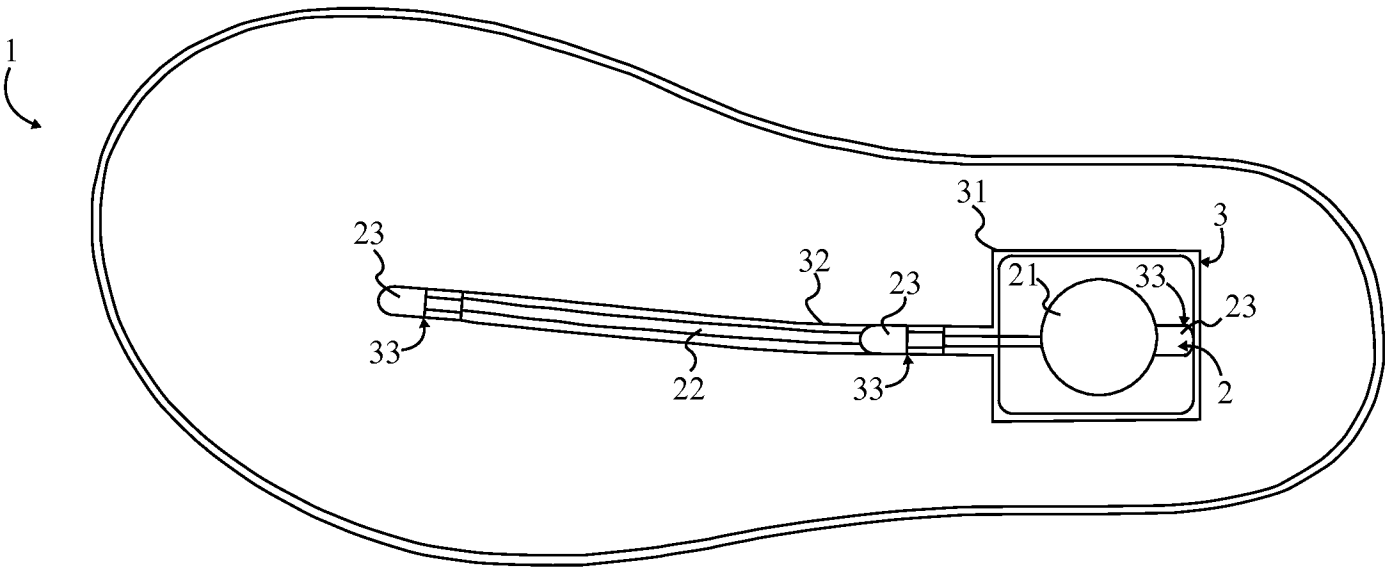
FIG. 3 is a top internal view of one embodiment of the present invention, showing the sole section with the translucent midsole and outsole being separately molded.
Figure 4:
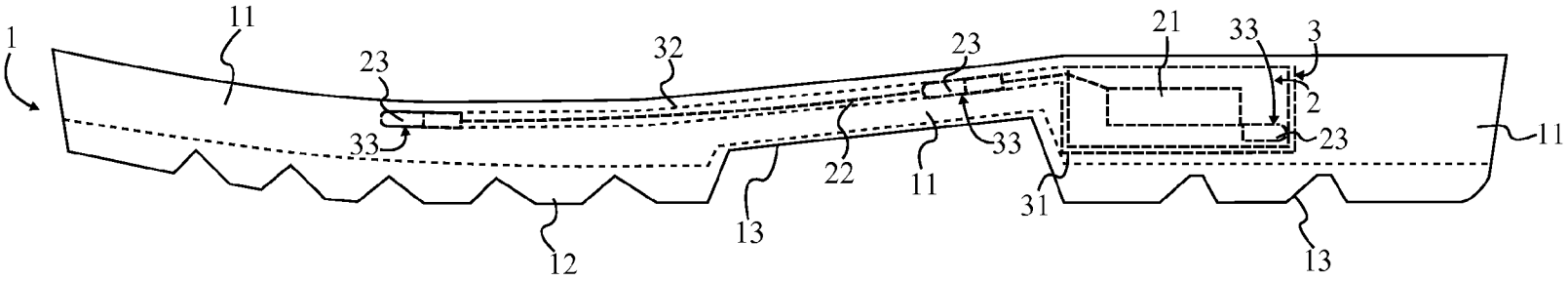
FIG. 4 is a side internal view of one embodiment of the present invention, showing the sole section with the translucent midsole and outsole being separately molded.

The illumination housing 3 comprises a power section 31, a plurality of channels 32, and a plurality of illumination sections 33. The illumination housing 3 is aligned so that the illumination system 2 is parallel with the top of the translucent midsole 11, as illustrated in FIG. 4, FIG. 6, FIG. 7, and FIG. 8. Each part of the illumination housing 3 is designed to contain a specific part of the illumination system 2. Due to this, the plurality of channels 32 traverse from the power section 31 to the plurality of illumination sections 33, as illustrated in FIG. 3, FIG. 4, FIG. 6, FIG. 7, and FIG. 8. In the preferred embodiment the illumination housing 3 is cut into the top of the translucent midsole 11 such that it is positioned internally within the translucent midsole 11, as illustrated in FIG. 3. Provided a singularly molded translucent footwear 4 or a singularly molded sole section 14 the illumination system 2 can be installed into the illumination housing 3 during the molding process. This is accomplished by positioning the illumination system 2 inside of the footwear mold prior to injection; once the molded is injected the final footwear is formed in a way that encapsulates the illumination system 2, completing installation of the illumination system 2.

The illumination system 2 comprises a power source 21, a plurality of electrical wires 22, and a plurality of illumination sources 23, examples of which can be seen in FIG. 3, FIG. 4, FIG. 6 and FIG. 7. These figures show the power source 21 being located in the power section 31 of the illumination housing 3. The plurality of electrical wires 22 are placed in the plurality of channels 32. Likewise, the plurality of illumination sources 23 are located in the plurality of illumination sections 33 of the illumination housing 3. The plurality of illumination sources 23 are provided power from the power source 21 by the plurality of electrical wires 22, which electrically connect the power source 21 to the plurality of illumination sources 23. The illumination sources 23 are preferably light-emitting diodes (LEDs), oriented so that light travels parallel to the plane of the translucent midsole 11. Light originating from the LEDs is affected as it approaches the edge of the translucent midsole 11. Some of the light from the LEDs will continue through the edge of the translucent midsole 11, perhaps refracting, but still leaving the translucent midsole 11. The light that is not transmitted will be internally reflected at the barrier between the translucent midsole 11 and the outside area. This internally reflected light will continue traveling within the translucent midsole 11 until reaching another edge of the translucent midsole 11, where the light will either be transmitted, refracted, or internally reflected again. Due to the internal reflection of the light, only a few LEDs need to be included to provide the desired internal illumination for the translucent midsole 11, whether molded separate from the outsole 12 or molded together with the outsole 12 and additionally with upper 41 as in a shoe jelly 4.

A wide variety of LEDs are available and can be used to achieve different effects as part of the illumination system 2. In addition to being available in different colors, LEDs can have different brightness values and viewing angles. LEDs with narrower viewing angles can be used to provide more intense beams of light, while larger viewing angles will provide a wider, more diffuse coverage of the translucent midsole 11. LEDs with different colors and brightness can be used together to create colorful and intriguing visual displays. A large amount of combinations are possible given the variety of LEDs in terms of color and other attributes.

In embodiments where the translucent midsole 11 is molded separate from the outsole 12, the illumination housing 3 could alternatively be cut into the bottom of the translucent midsole 11, rather than the top. In this configuration, the illumination system 2 is held in place by both friction and the outsole 12. Prior to connecting the outsole 12 to the translucent midsole 11, the illumination system 2 must be placed in the illumination housing 3. After the outsole 12 is connected to the translucent midsole 11 the illumination system 2 will no longer be accessible.

Figure 12:
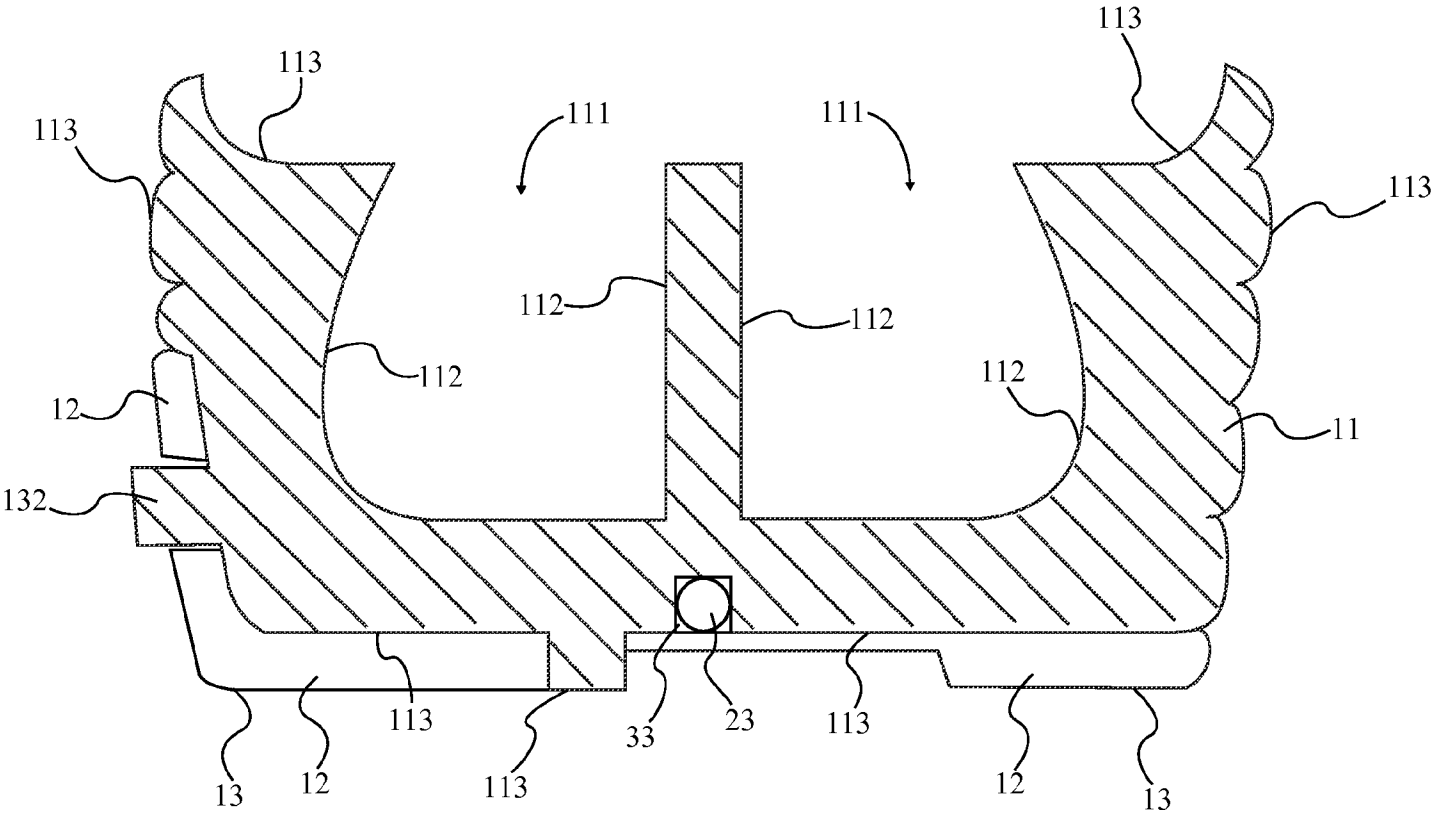
FIG. 12 is a section view showing the interior of a skeleton embodiment of the present invention.

In other embodiments the translucent midsole 11 may be built with a skeleton design 114 instead of being built with a solid design. The term "solid design" is used to refer to any footwear in which the sole section 1 is an unbroken component, without any walls or similar independent structure supporting members. Examples of a solid design include a sole section 1 with a 100% solid PVC construction, a singularly molded footwear (e.g. the earlier referenced jelly shoe and rain boot), or a combination thereof. These examples are not intended to be limiting as there are additional possible embodiments which may be defined as having a solid design. The skeleton midsole has open interior sections 111 formed by a plurality of internal walls 112 and a plurality of external walls 113, which can be produced in various arrangements such as those shown in FIG. 12. The open interior sections 111 are defined by the internal walls 112 and the external walls 113, with the external walls 113 laterally enclosing both the open interior sections 111 and internal walls 112. To enhance the internal passage of light within the skeleton translucent midsole 11 parts of the production mold, specifically those that correspond to the internal walls 112, are electroplated. This eliminates most, if not all, of the reflection or refraction of light as it relates to the internal walls 112 of the translucent midsole 11. Electroplating these specific areas of the production mold, in which the translucent midsole 11 is produced, creates the smoothest and thus clearest surface possible thus enhancing the internal illumination of the translucent midsole 11. In contrast with these mold parts relating to the internal walls 112, the parts of the mold corresponding to the external walls 113 are non-electroplated. Further promoting internal reflection and full illumination of the translucent midsole 11, a fillet is used to join the internal walls 112 to a base of the translucent midsole 11; thus the internal walls 112 curve as they merge into the internal base. Said curvature creates an easy pathway for light to travel through, enhancing the internal illumination in this skeleton embodiment.

Figure 13:
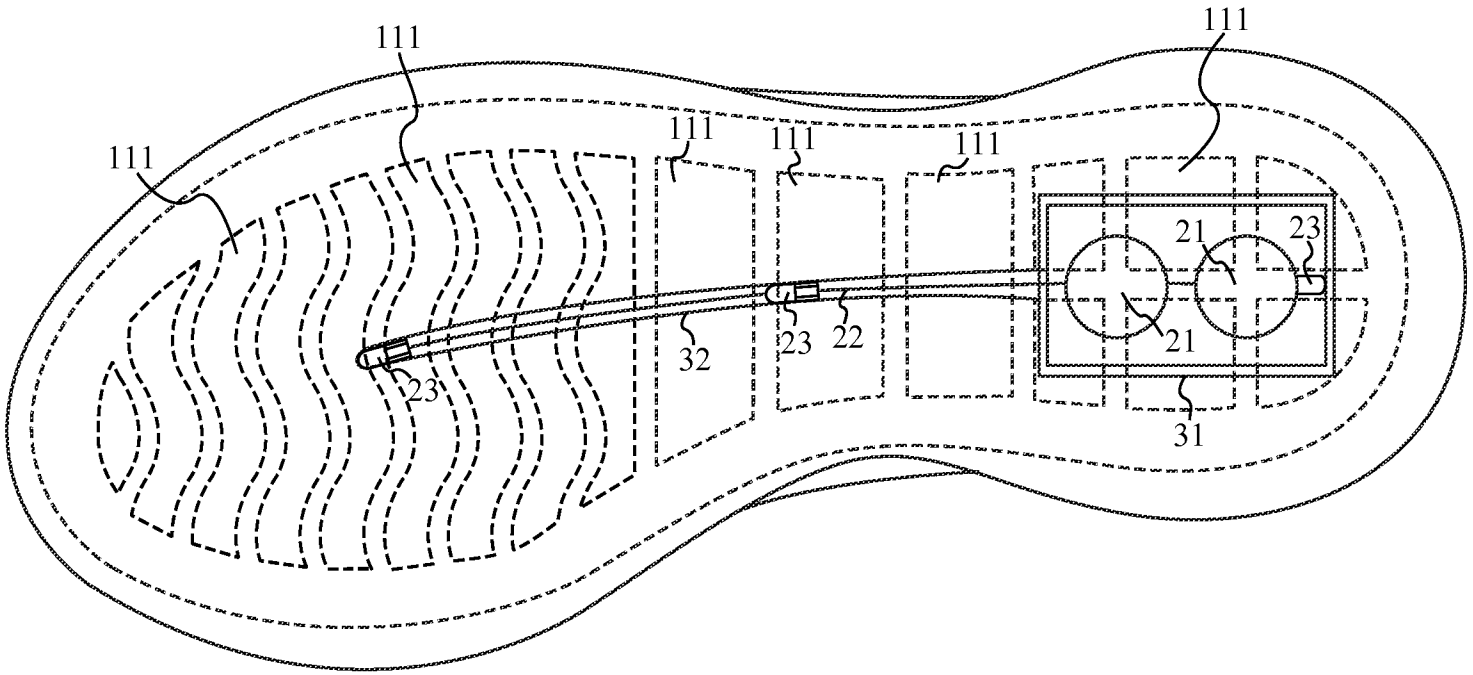
FIG. 13 is a bottom view of a left foot showing a skeleton embodiment of the present invention with a bottom mounted illumination system.
Figure 14:
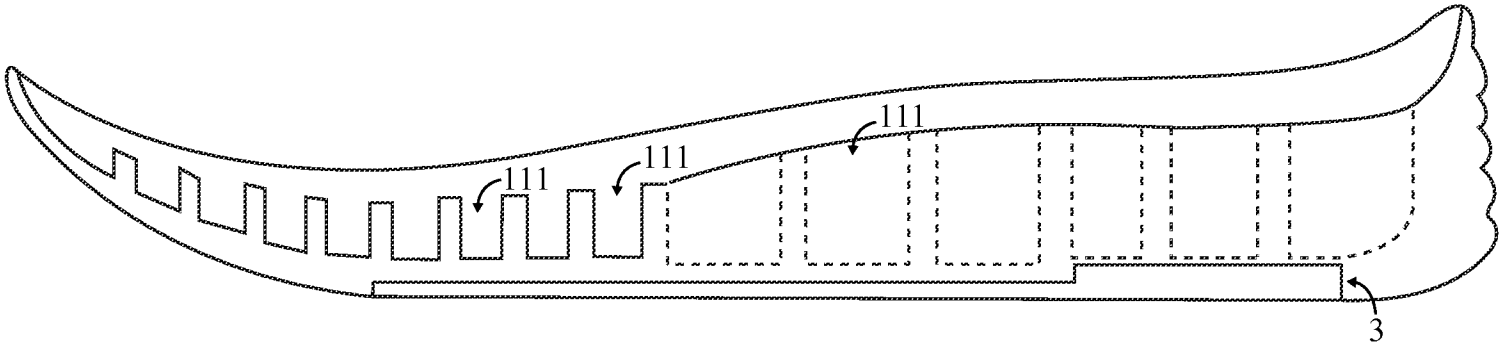
FIG. 14 is a split view from heel to toe showing a skeleton embodiment of the present invention with a bottom mounted illumination system.
Figure 15:
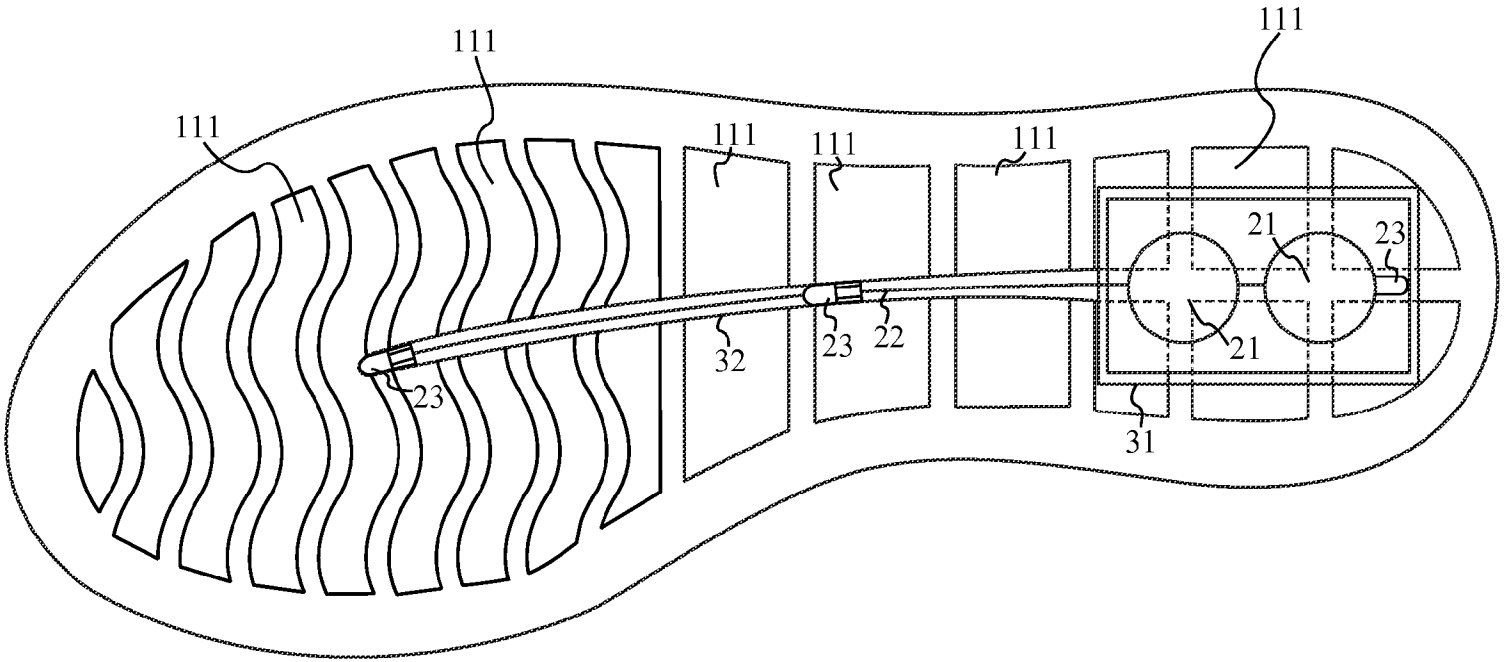
FIG. 15 is a top view of a right foot showing a skeleton embodiment of the present invention with a top mounted illumination system.
Figure 16:
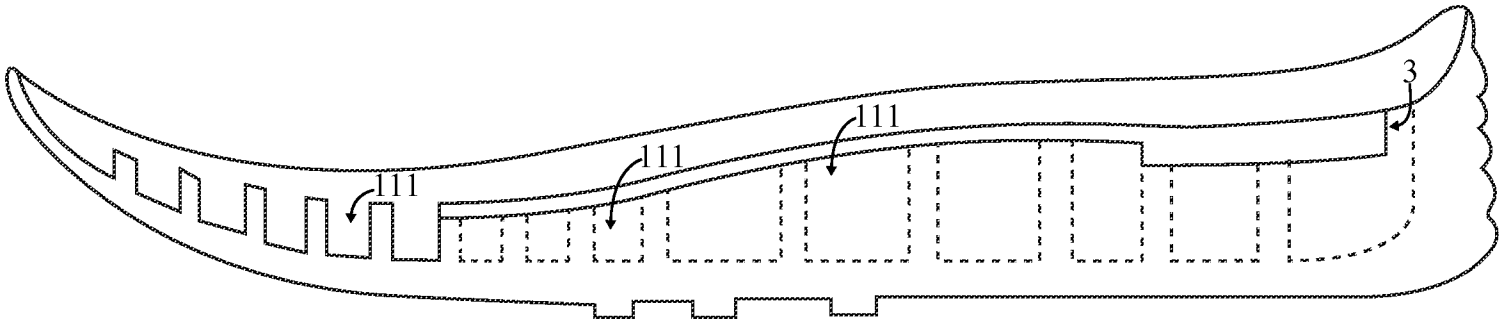
FIG. 16 is a split view from heel to toe showing a skeleton embodiment of the present invention with a top mounted illumination system.

When employing a skeleton midsole variations are possible in the configuration of the illumination system 2, translucent midsole 11, and outsole 12. In a first variation, the illumination system 2 is installed in the bottom of the translucent midsole 11, with the outsole design sections 121 being positioned to overlap with the plurality of illumination sources 23. In a second variation, the illumination system 2 is again installed in the bottom of the translucent midsole 11, but the outsole design sections 121 do not overlap the plurality of illumination sources 23. Examples of a bottom mounted illumination system 2 are shown in FIG. 13 and FIG. 14. In a third variation, the illumination system 2 is installed in the top of the translucent midsole 11, while the outsole design sections 121 can be positioned anywhere; this variation works the same whether or not the outsole design sections 121 overlap the illumination sources 23. Examples of a top mounted illumination system 2 are seen in FIG. 15 and FIG. 16.

Figure 17:
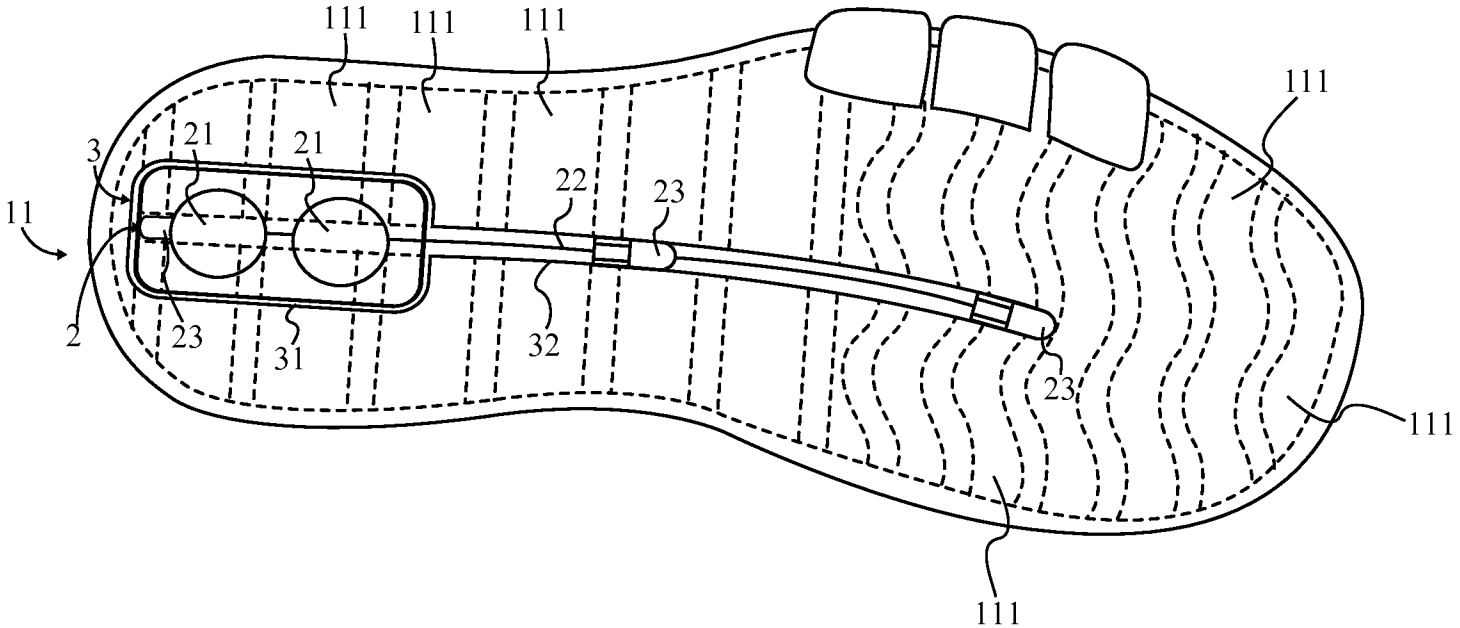
FIG. 17 is a bottom view of a right foot skeleton midsole design of a first skeleton embodiment of the present invention with a bottom mounted illumination system.
Figure 18:
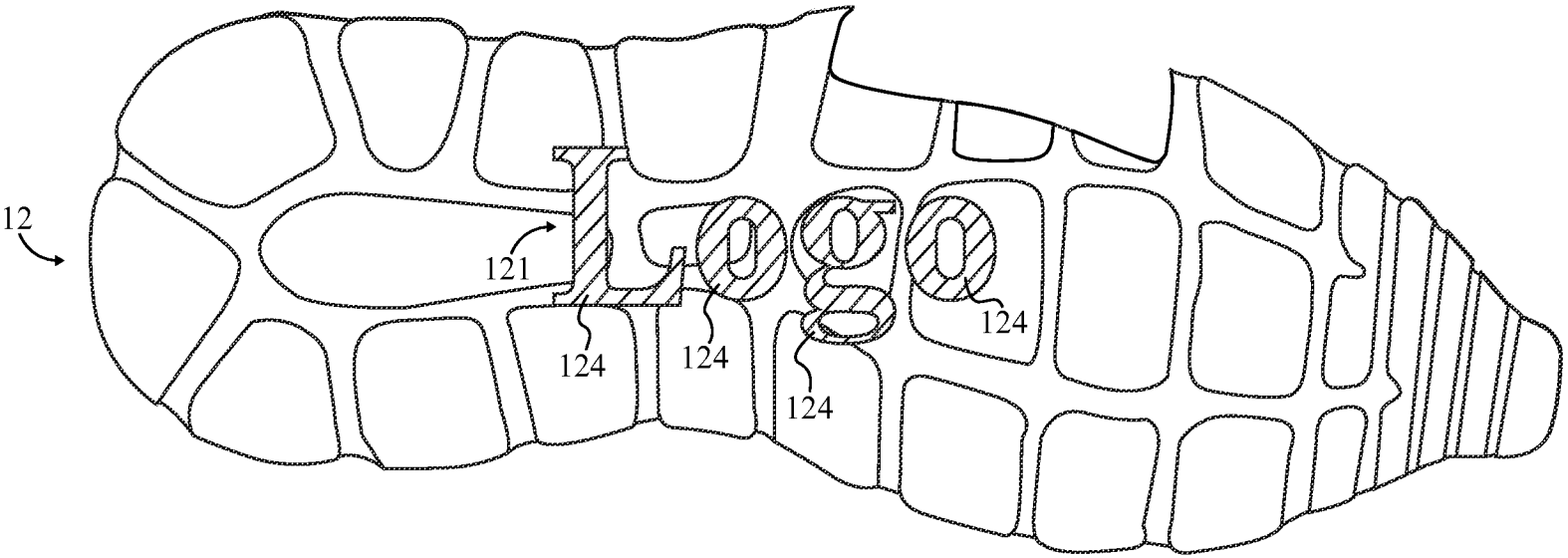
FIG. 18 is a bottom view of an outsole design of a first skeleton embodiment of the present invention.
Figure 19:
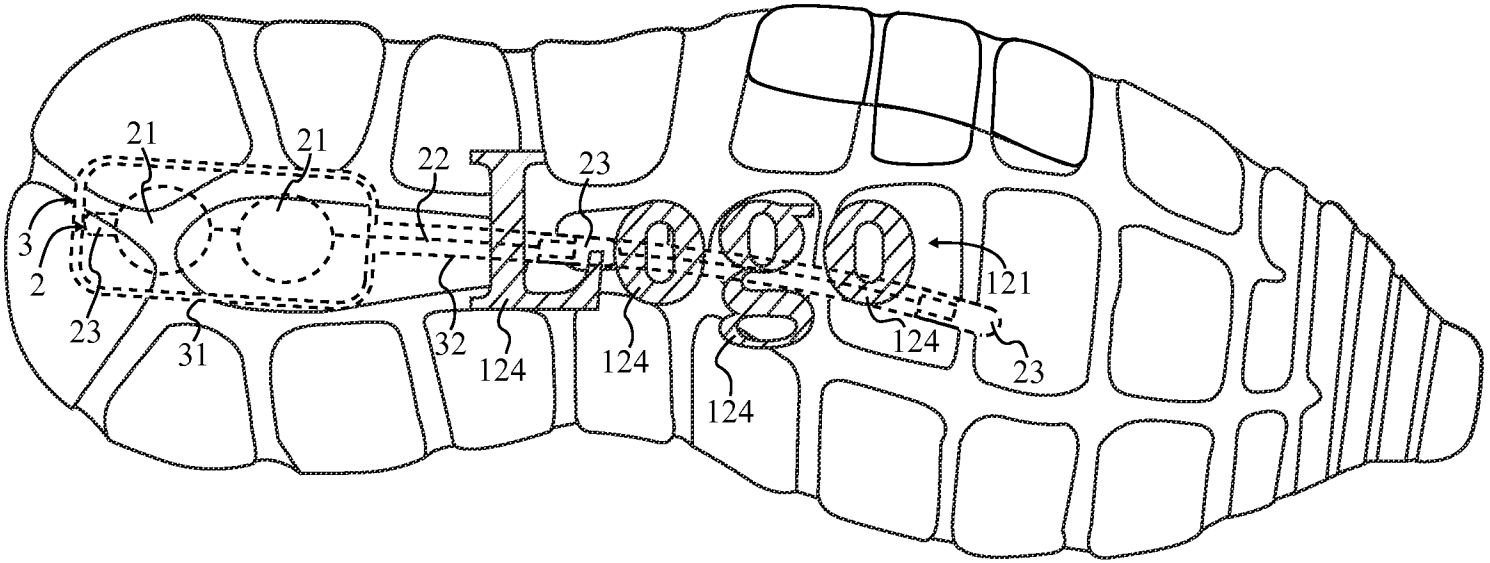
FIG. 19 is a bottom view of a combined skeleton midsole and outsole of a first skeleton embodiment of the present invention.
Figure 20:
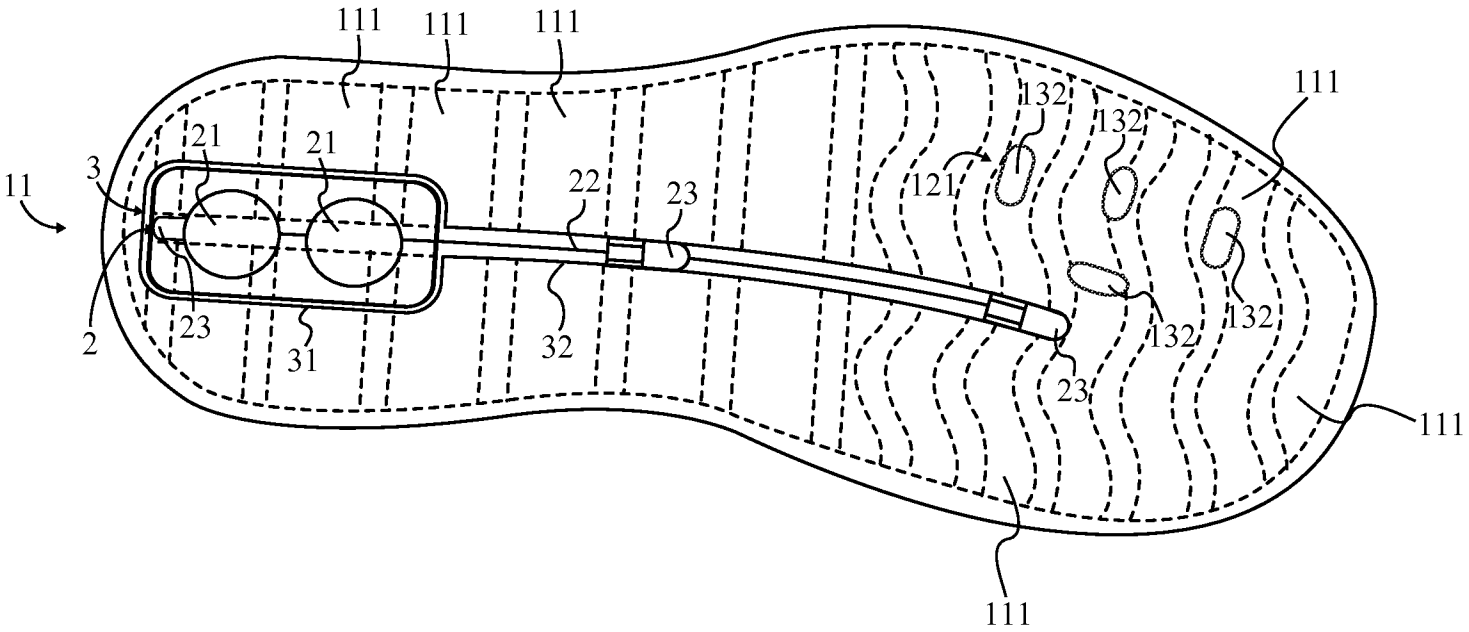
FIG. 20 is a bottom view of a right foot skeleton midsole design of a second skeleton embodiment of the present invention with a bottom mounted illumination system and a midsole.
Figure 21:
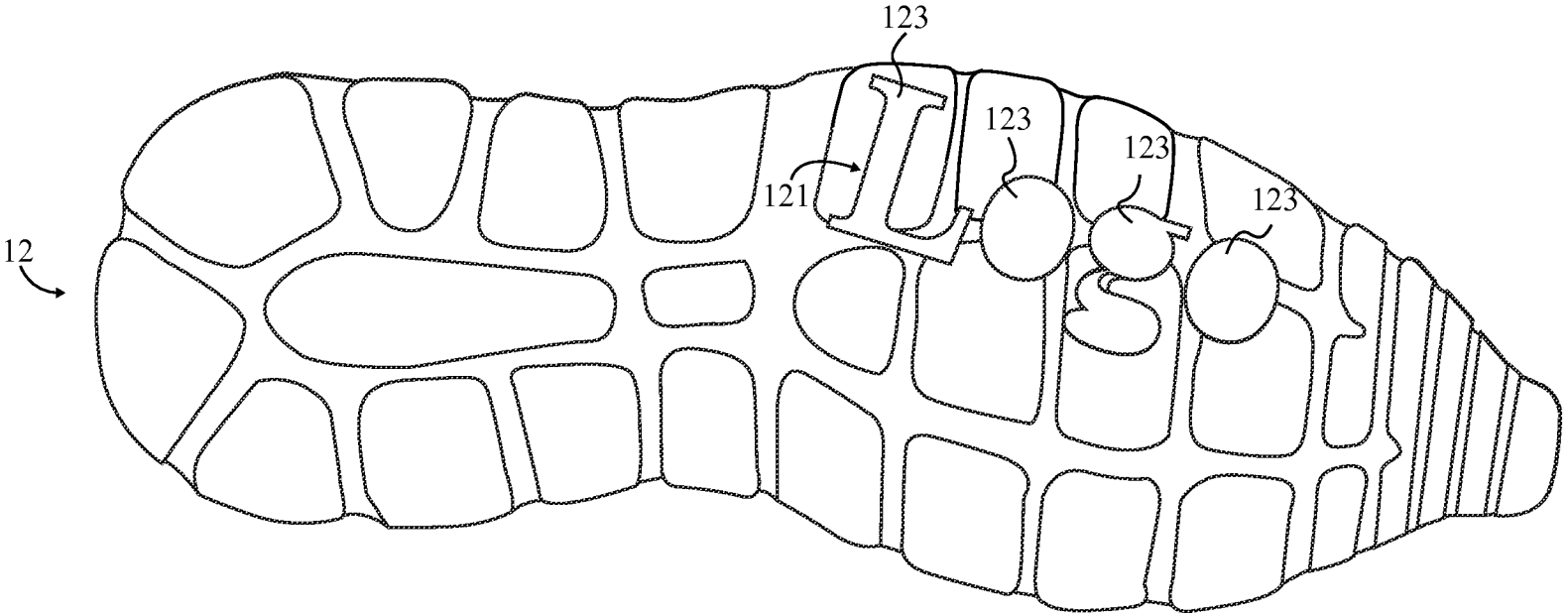
FIG. 21 is a bottom view of an outsole design of a second skeleton embodiment of the present invention.
Figure 22:
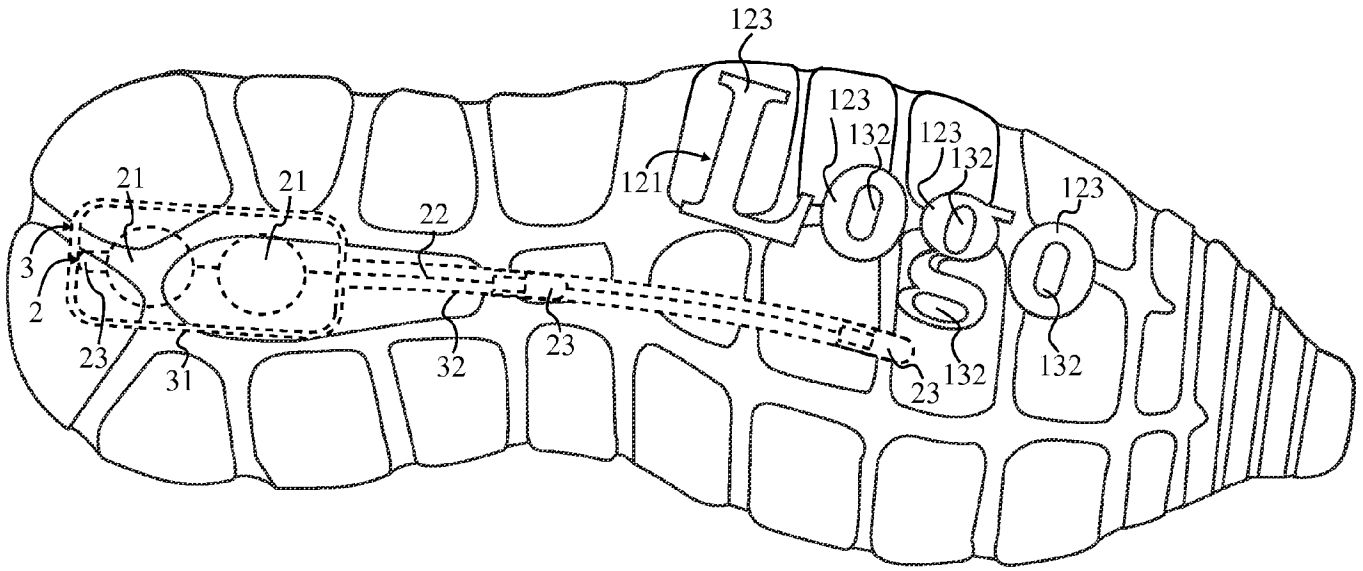
FIG. 22 is a bottom view of a combined skeleton midsole and outsole of a second skeleton embodiment of the present invention.
Figure 23:
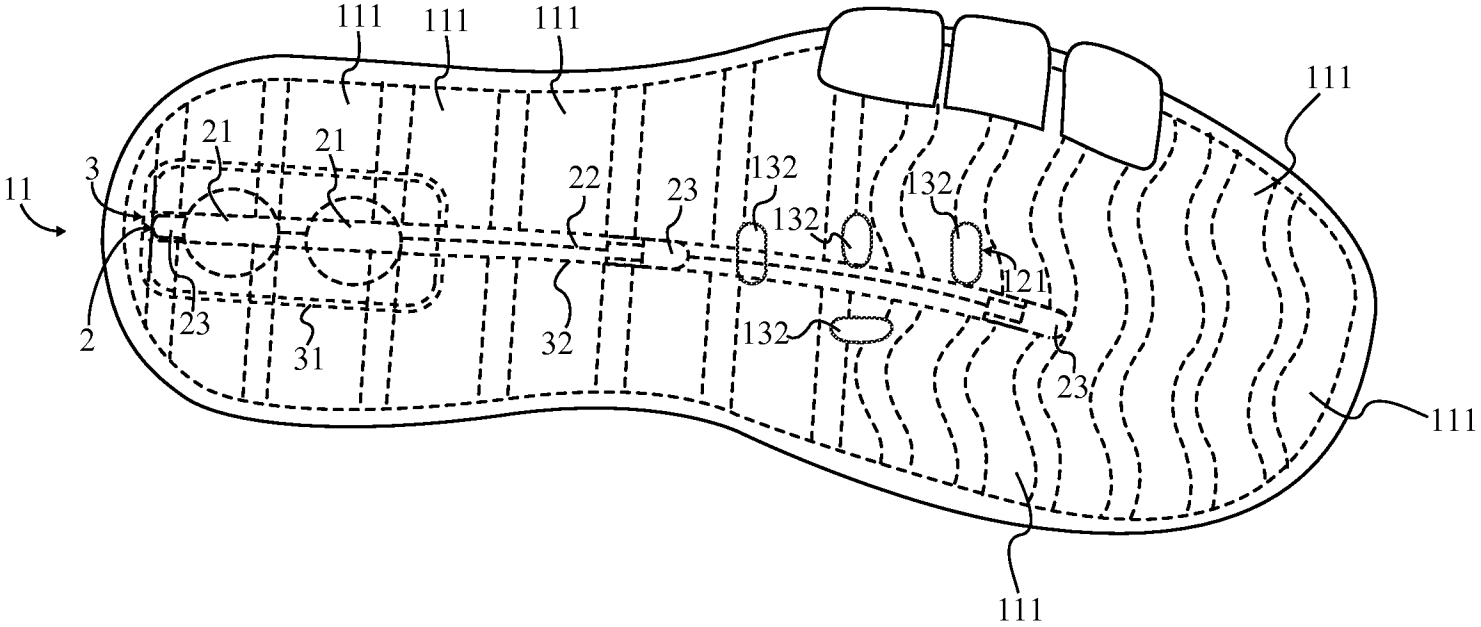
FIG. 23 is a bottom view of a right foot skeleton midsole design of a third skeleton embodiment of the present invention with a top mounted illumination system and a midsole.
Figure 24:
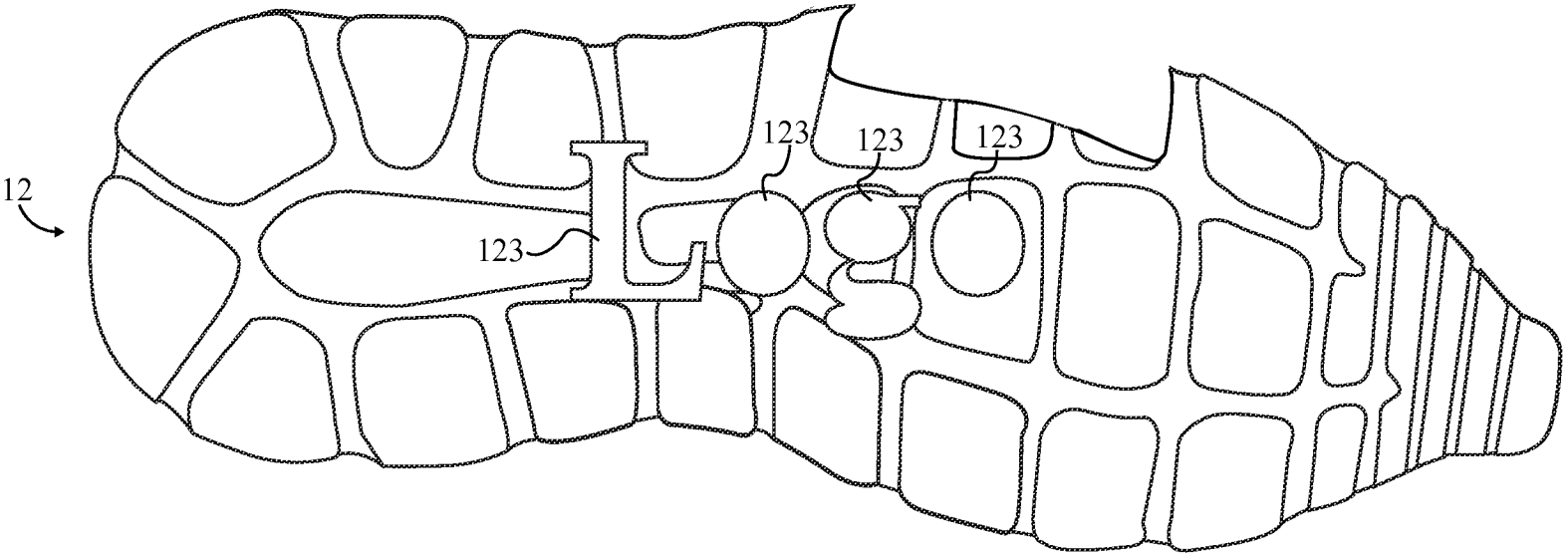
FIG. 24 is a bottom view of an outsole design of a third skeleton embodiment of the present invention.
Figure 25:
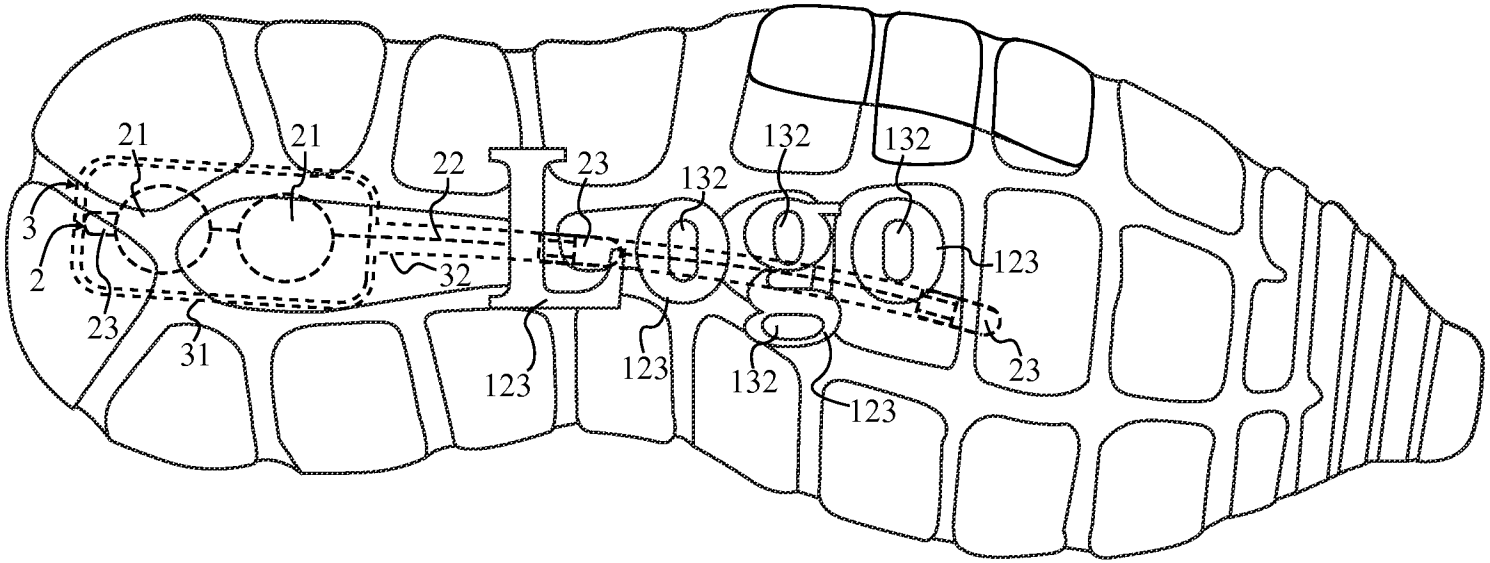
FIG. 25 is a bottom view of a combined skeleton midsole and outsole of a third skeleton embodiment of the present invention.

In the first variation, the outsole 12 (FIG. 18) connects to the translucent midsole 11 (FIG. 17), with the outsole design sections 121 overlapping a portion of the illumination system 2 and illumination sources 23, as shown in FIG. 19. In the second variation, as with the first variation, the outsole 12 (FIG. 21) is connected to the translucent midsole 11 (FIG. 20) adjacent to the illumination system 2. However, unlike the first variation, the outsole design sections 121 do not overlap with the illumination system 2, as shown in FIG. 22. This allows cavities 123 to be positioned into the outsole 12 without exposing the illumination housing 3 and illumination system 2. In the third variation, the outsole 12 (FIG. 24), is connected to the bottom of the translucent midsole 11 (FIG. 23) to create the sole section 1 (FIG. 25). The illumination system 2 is conversely installed in the top section of the translucent midsole 11. As a result, the illumination system 2 will not interfere with the outsole design sections 121, regardless of whether the outsole design sections 121 overlaps the illumination system 2 or not.

The present invention is not limited to solid or skeleton designs for the translucent midsole 11. Other translucent midsole 11 designs can be utilized with the present invention.

Figure 26:
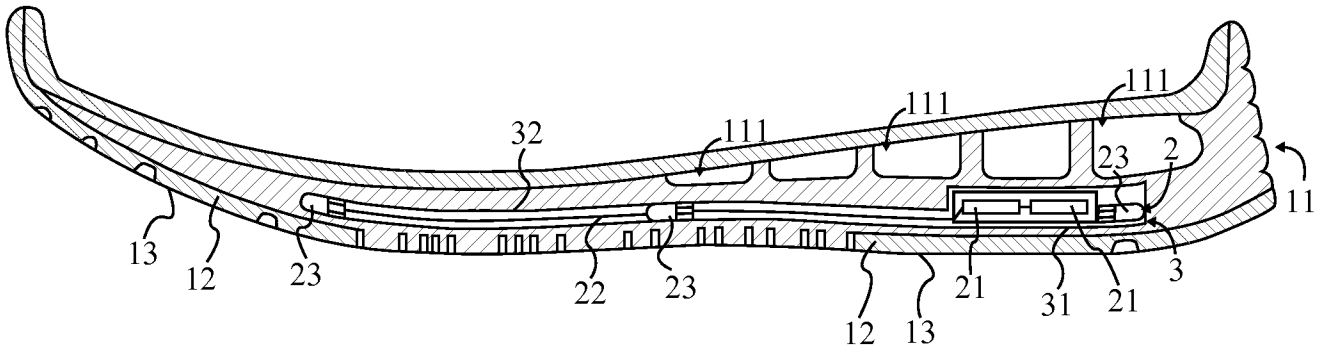
FIG. 26 is a split view from heel to toe showing a partial skeleton midsole embodiment of the present invention.

Combinations are also possible, such as a partial skeleton design as shown in FIG. 26 that combines a solid construction translucent midsole 11 with a skeleton construction translucent midsole 11. In an example of a partial skeleton design the front portion of the translucent midsole 11 is solid while the rear portion comprises a low profile skeleton. The illumination system 2 is placed inside of the mold prior to the multicolor molding process. Once the mold is injected forming the partial skeleton translucent midsole 11, the illumination system 2 is permanently encapsulated within the partial skeleton translucent midsole 11. FIG. 26 provides a visual representation of this partial skeleton design example.

In one potential embodiment the outsole 12 of the sole section 1 is translucent. In this potential embodiment the entire sole section 1 is illuminated, as both the translucent midsole 11 and outsole 12 are light-permeable. The illumination sources 23 that internally illuminate the translucent midsole 11 also illuminate the outsole 12. The illumination of the outsole 12 results from light originating from the illumination sources 23 crossing a boundary between the translucent midsole 11 and the outsole 12. If the translucent midsole 11 and the outsole 12 have the same index of refraction, then no bending of light occurs between the translucent midsole 11 and the outsole 12. In such a scenario the outsole 12, along with the translucent midsole 11, is effectively internally illuminated by the illumination sources 23. It is noted that if the translucent midsole 11 and the outsole 12 are integrally molded to form the sole section 1 (e.g. a shoe jelly 4) then both the translucent midsole 11 and the outsole 12 are internally illuminated by the plurality of illumination sources 23. In this embodiment with a outsole 12 being translucent, the plurality of outsole design sections 121 is a plurality of opaque sections 122 with the plurality of opaque sections 122 traversing through the outsole 12. The plurality of opaque sections 122 create "negative space" with regards to the light from the illumination sources 23. Since the opaque sections 122 block light, the opaque sections 122 contrast with the translucent and illuminated outsole 12. The outsole design sections 121 are seen as dark areas rather than lit areas, hence the term "negative space". As previously mentioned, the outsole design sections 121 can be configured such that they form the tread pattern 15 of the outsole 12.

Figure 8:
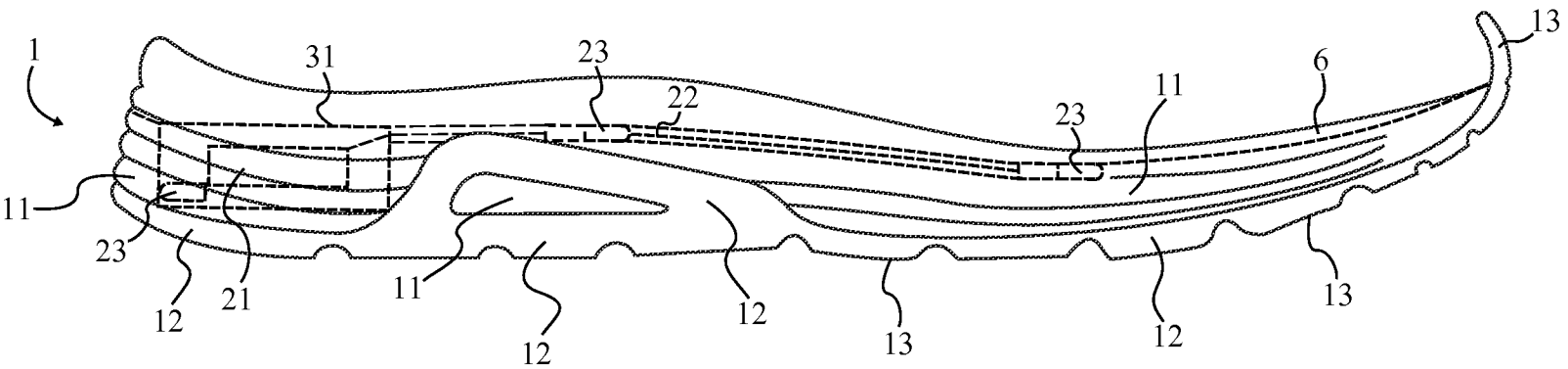
FIG. 8 is a side internal view of another embodiment of the present invention.

In another potential embodiment the outsole 12 of the sole section 1 is opaque. In the embodiment with an opaque outsole 12 there are a number of variations for how the plurality of outsole design sections 121 are implemented. In one variation of this opaque outsole 12 embodiment the plurality of outsole design sections 121 is a plurality of cavities 123 in the outsole 12. The plurality of cavities 123 traverse through the outsole 12, causing the translucent midsole 11 to be visible through the plurality of cavities 123. As the outsole 12 is opaque it effectively causes a "blackout" of light from the illumination sources 23 in the translucent midsole 11, with the exception of the plurality of cavities 123 which allow the internally illuminated translucent midsole 11 to be seen. Since the internally illuminated translucent midsole 11 is visible through the plurality of cavities 123, the formed logos, designs, treads and other illustrations appear to be illuminated. The outsole 12 acts as an outline for the plurality of cavities 123, with the light passing through the plurality of cavities 123 contrasting with the surrounding unlit and opaque outsole 12. In this embodiment, and indeed all embodiments that combine an opaque outsole 12 with the translucent midsole 11, light from the translucent midsole 11 passes through the outsole design sections 121 such that the outsole design sections 121 appear to be illuminated without requiring individual sources of light to form each part of the intended design. There are different ways of implementing the outsole design sections 121 with the outsole 12, with the possible methods being later explained in more detail. An example of an opaque outsole 12 is shown in FIG. 8, where the outsole 12 actually wraps around the side of the footwear and creates a design along the side of the translucent midsole 11. The illustration in FIG. 8 depicts a sole section 1 where the translucent midsole 11 and opaque outsole 12 may be created from either a single multicolor mold or from separately molded components.

In one variation of the embodiment with an opaque outsole 12, the plurality of cavities 123 is filled by a plurality of design inserts 132. Sub-variations are possible, including one in which the translucent midsole 11 comprises the plurality of design inserts 132 and another where each of the plurality of design inserts 132 are separate pieces.

In the sub-variant where the translucent midsole 11 comprises the plurality of design inserts 132, the translucent midsole 11 also comprises a main body 131. The main body 131 is connected onto and across the outsole 12, similar to the configuration of the translucent midsole 11 in other embodiments. Formed as part of the translucent midsole 11, the plurality of design inserts 132 traverse from the main body 131 into the plurality of cavities 123. The length of the plurality of design inserts 132 can be varied such that the design inserts 132 are recessed compared to the outsole 12, flush with the outsole 12, or protruded past the outsole 12. In the recessed example, the plurality of design inserts 132 traverse into plurality of cavities 123 but terminate before reaching the bottom surface 13 of the outsole 12; the plurality of design inserts 132 is thus shorter than the plurality of cavities 123. In the flush example, the plurality of design inserts 132 traverse into the plurality of cavities 123 and terminate at the bottom surface 13 of the outsole 12; the plurality of design inserts 132 is the same length as the plurality of cavities 123 and is flush with the bottom surface 13 of the outsole 12. In the protruded example, the plurality of design inserts 132 traverse out of the plurality of cavities 123, terminating outside the outsole 12; the plurality of design inserts 132 is thus longer than the plurality of cavities 123. In this latter case the plurality of design inserts 132 function as treads (as part of a treat pattern of the outsole 12) or spikes and help to provide better traction. It is noted that in this sub-variant the plurality of design inserts 132 is translucent as it is an extension of the translucent midsole 11.

In the sub-variant where each of the plurality of design inserts 132 are separate pieces, the plurality of design inserts 132 is connected to the translucent midsole 11 and traverses into the plurality of cavities 123, similar to its configuration when part of the translucent midsole 11 as formerly described. As with the other sub-variant, the length of the plurality of design inserts 132 can be varied such that the design inserts 132 are recessed compared to the outsole 12, flush with the outsole 12, or protruded past the outsole 12. When the plurality of design inserts 132 is recessed, it is defined as traversing from the translucent midsole 11 into the plurality of cavities 123, with the plurality of design inserts 132 being shorter than the plurality of cavities 123. When the plurality of design inserts 132 is flush, it is defined as traversing from the translucent midsole 11 into the plurality of cavities 123, with the plurality of design inserts 132 being equal in length to the plurality of cavities 123 and flush with the bottom surface 13 of the outsole 12. When the plurality of design inserts 132 is protruded, it is defined as traversing from the translucent midsole 11 out of the plurality of cavities 123, with the plurality of design inserts 132 being longer than the plurality of cavities 123, potentially forming treads or cleats.

These configurations for the plurality of design inserts 132 mirror those described in the sub-variant in which the translucent midsole 11 comprises the plurality of design inserts 132.

As an alternative to the plurality of cavities 123, the plurality of outsole design sections 121 may instead be a plurality of translucent sections 124 in the outsole 12. The plurality of outsole design sections 121 traverses through the midsole to allow the translucent midsole 11 to be visible through the plurality of outsole design sections 121. Similar to plurality of cavities 123, the plurality of translucent sections 124 allows light from the plurality of illumination sources 23 to pass through the plurality of translucent sections 124 in order to create a desired composite illuminated design.

By implementing the outsole design sections 121 as the previously described cavities 123, design inserts 132, translucent sections 124, or a combination thereof, a number of methods for displaying designs are made possible. These methods are referred to as "blackout" methods. The outsole design sections 121, which allow the passage of light, can be configured to form designs, logos, treads and other embellishments with the present invention. Individual outsole design sections 121 can take numerous forms, depending on the intended overall design. A common and simple design is a word across the sole of the footwear, such as the name of the product or the brand. In this instance, the outsole design sections 121 are simply the letters that form the product name.

Figure 27:
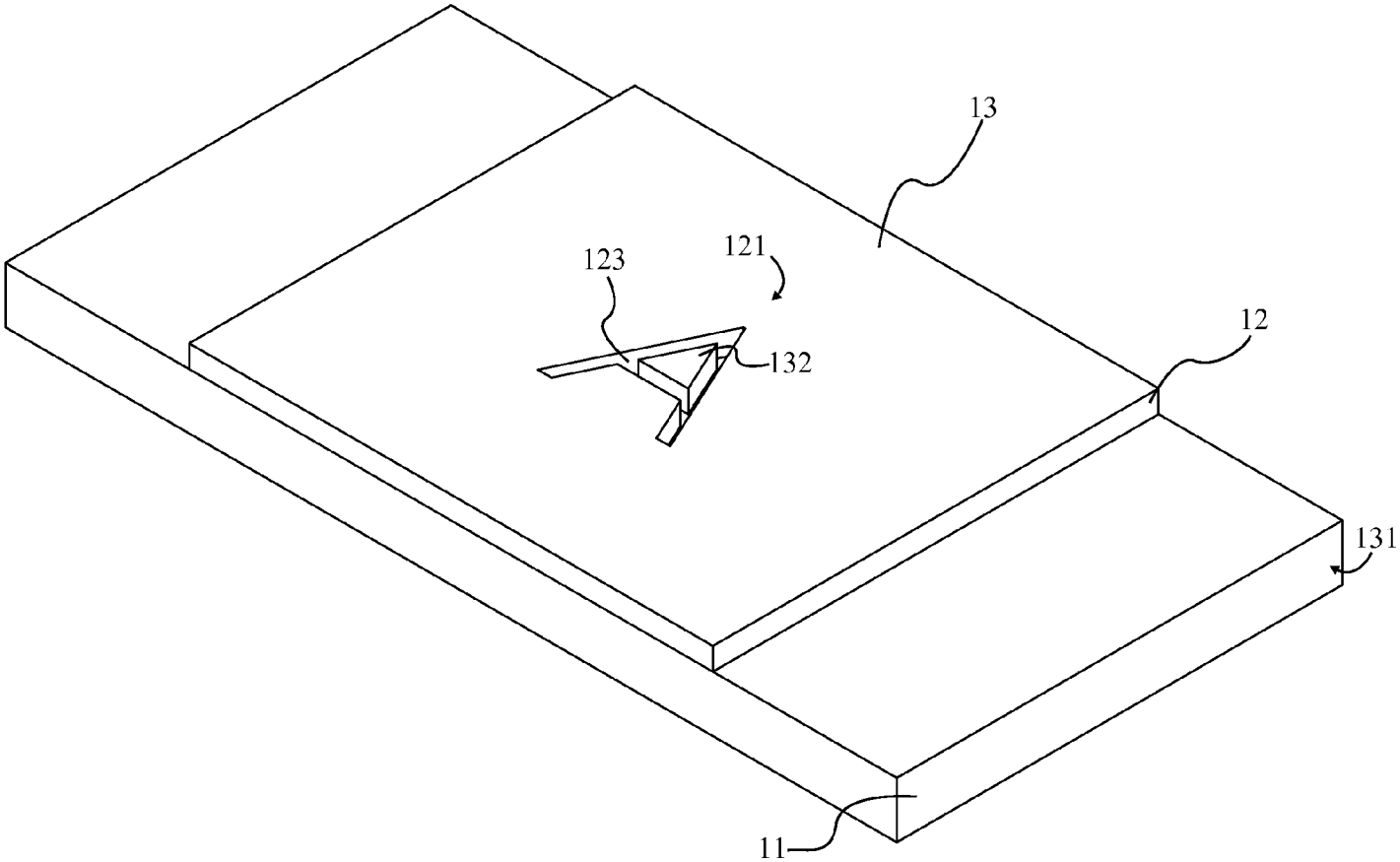
FIG. 27 is a perspective view showing a first blackout method of one embodiment of the present invention.

In a first blackout method, shown in FIG. 27, the plurality of cavities 123 are combined with the plurality of design inserts 132 to create a desired composite design. The plurality of cavities 123, as described earlier, traverses through the outsole 12 in order to allow the translucent midsole 11 to be visible through the opaque outsole 12. In this first blackout method the plurality of design inserts 132 is part of the translucent midsole 11 and traverses into the plurality of cavities 123. Since the plurality of design inserts 132 is translucent (being part of the translucent midsole 11), light is able to pass through them in contrast with the surrounding opaque outsole 12. As a result, when the sole section 1 is viewed from the bottom, the design (e.g. product name) is defined by the plurality of cavities 123 and the plurality of design inserts 132. It essentially appears that the design is illuminated, even though only the translucent midsole 11 is truly illuminated.

Figure 28:
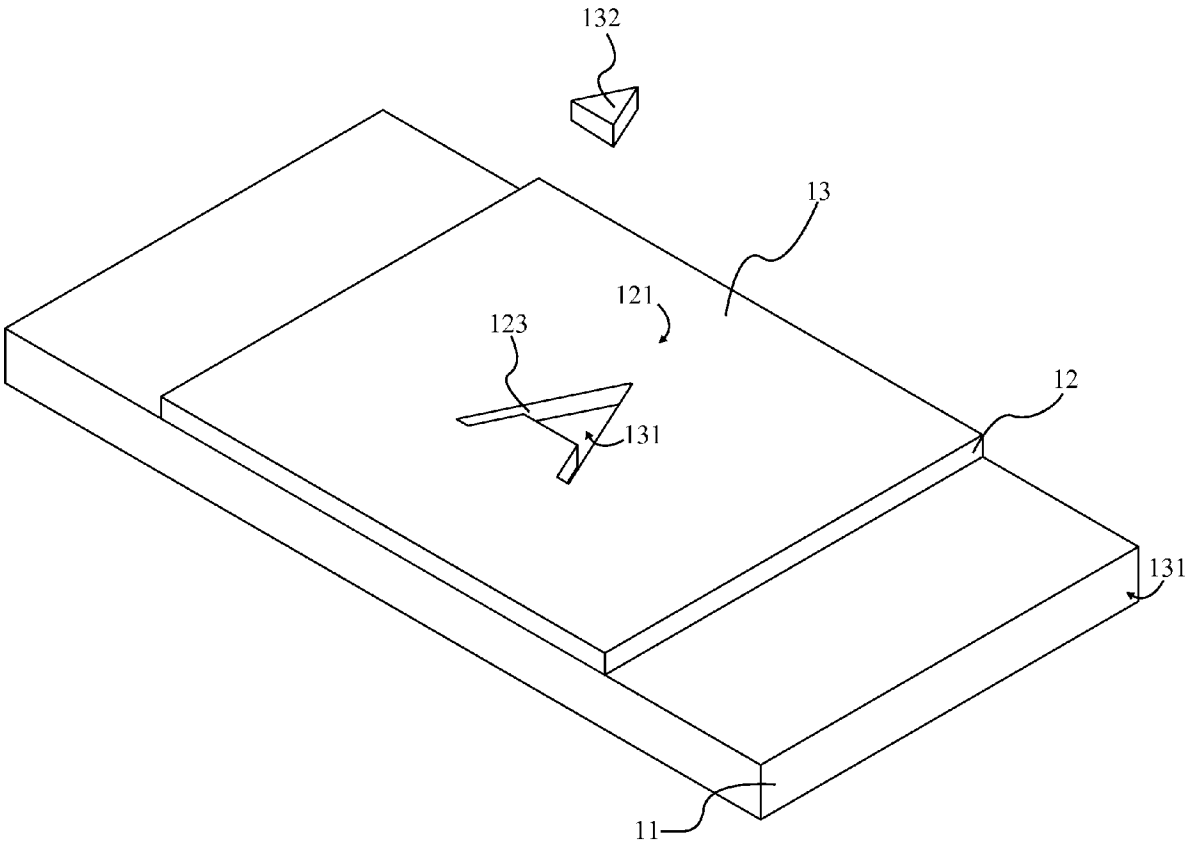
FIG. 28 is a perspective view showing a second blackout method of one embodiment of the present invention.

In a second blackout method, shown in FIG. 28, the plurality of cavities 123 are again combined with the plurality of design inserts 132 to create the desired composite design. The plurality of cavities 123 still traverses through the outsole 12 to allow the translucent midsole 11 to be visible and the plurality of design inserts 132 still traverses into the plurality of cavities 123. Each of the plurality of design inserts 132, however, are separate pieces from the translucent midsole 11 and are thus connected to the translucent midsole 11. In this second blackout method, the design inserts 132 do not completely fill the cavities 123, and are furthermore opaque rather than translucent. This is necessary for certain designs that have an interior outline as well as an exterior outline; the interior outline cannot be properly represented by a cavity and translucent design insert. For example, with letters and numbers such as "A", "O", "R", "Q", "9", and "6", there are center portions (e.g. the interior triangle in "A") that cannot be cut from the outsole 12. In order to address this the second blackout method is applied, with the opaque design inserts 132 being connected to the translucent midsole 11 in order to form interior outlines as necessary. This is in contrast to the first blackout method, in which interior outlines are difficult to distinguish from internal outlines as the entire cavity and design insert appear to be illuminated via the translucent midsole 11.

Figure 29:
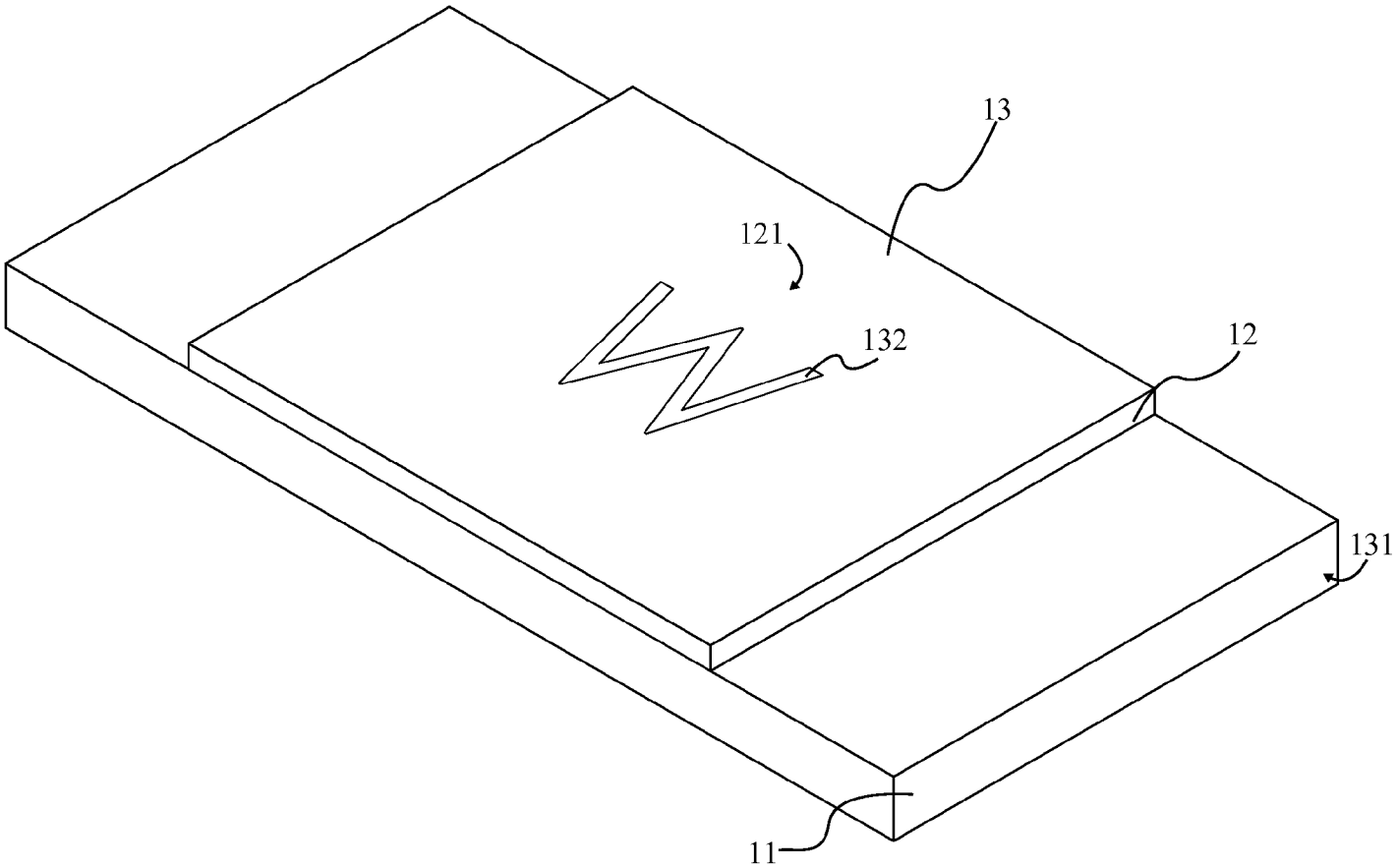
FIG. 29 is a perspective view showing a third blackout method of one embodiment of the present invention.
Figure 30:
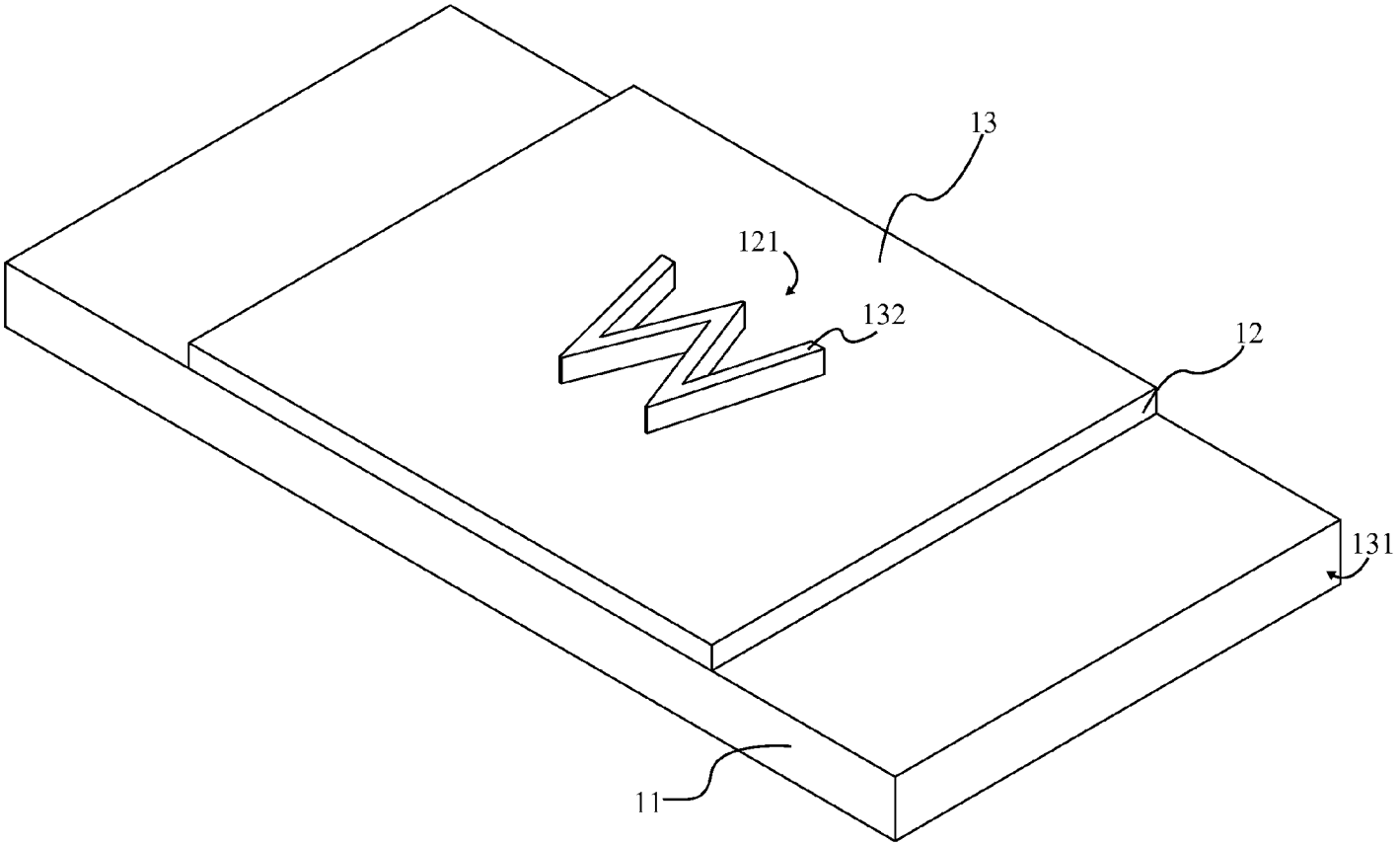
FIG. 30 is a perspective view showing a fourth blackout method of one embodiment of the present invention.
Figure 31:
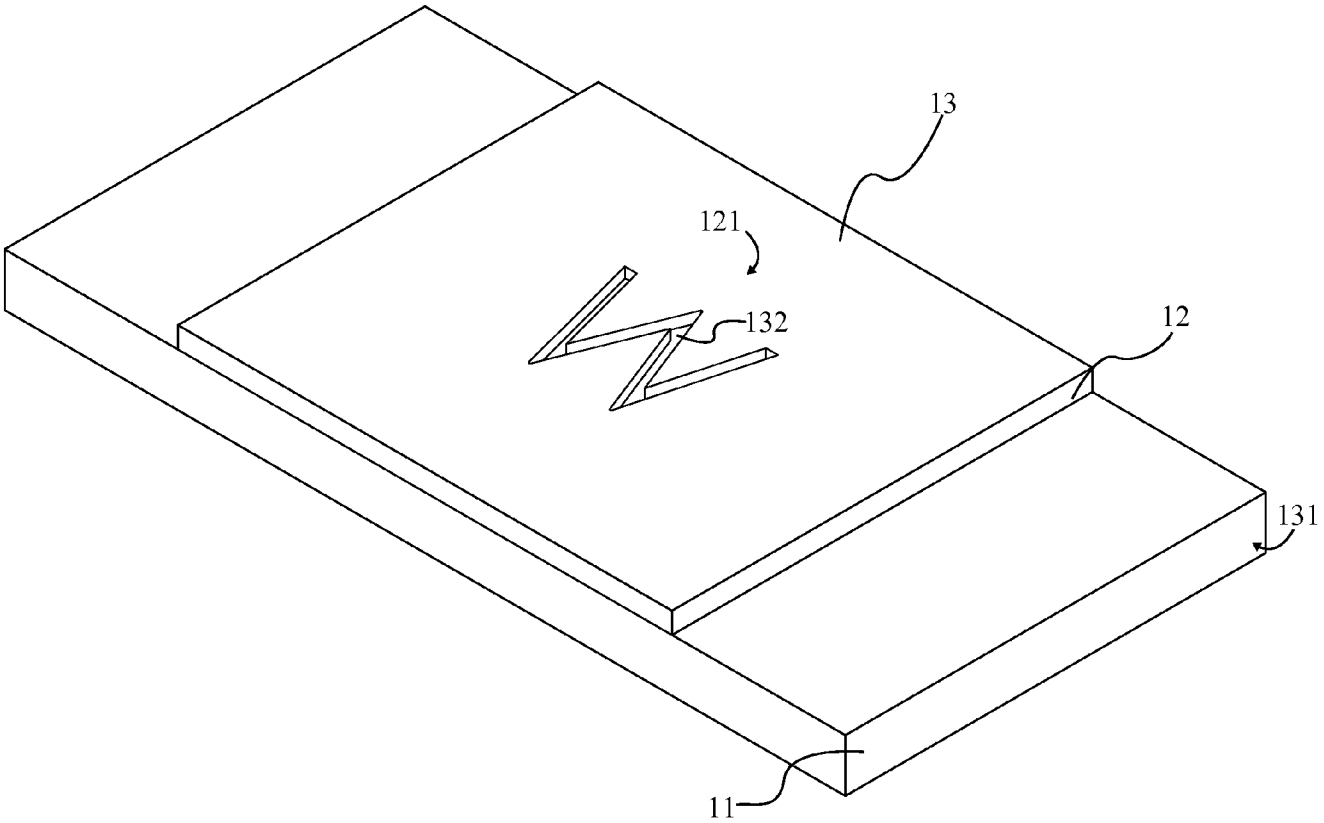
FIG. 31 is a perspective view showing a fifth blackout method of one embodiment of the present invention.

In a third blackout method shown in FIG. 29, the design inserts 132 traverse into the plurality of cavities 123. Each of the design inserts 132 are of an equal length of the cavities 123, resulting in the design inserts 132 being flush with the bottom surface 13 of the sole. This blackout method can be applied to different embodiments of the present invention; embodiments in which the design inserts 132 are part of the translucent midsole 11 or are separate independent translucent pieces can both utilize the third blackout method. A fourth blackout method and a fifth blackout method share the same configuration as the third blackout method, primarily changing the length of the design inserts 132 in relation to the depth of the cavities 123. In the fourth blackout method, depicted in FIG. 30, the design inserts 132 traverse out of the cavities 123 rather than being flush with the bottom surface 13. Protruding from the translucent midsole 11, the design inserts 132 are able to function as part of a tread pattern 15 and even spikes if so desired. In a fifth blackout method, as depicted in FIG. 31, the design inserts 132 are similar to those of the third and fourth blackout methods but are instead recessed into the outsole 12, with the design inserts 132 being shorter than the depth of the cavities 123.

Figure 32:
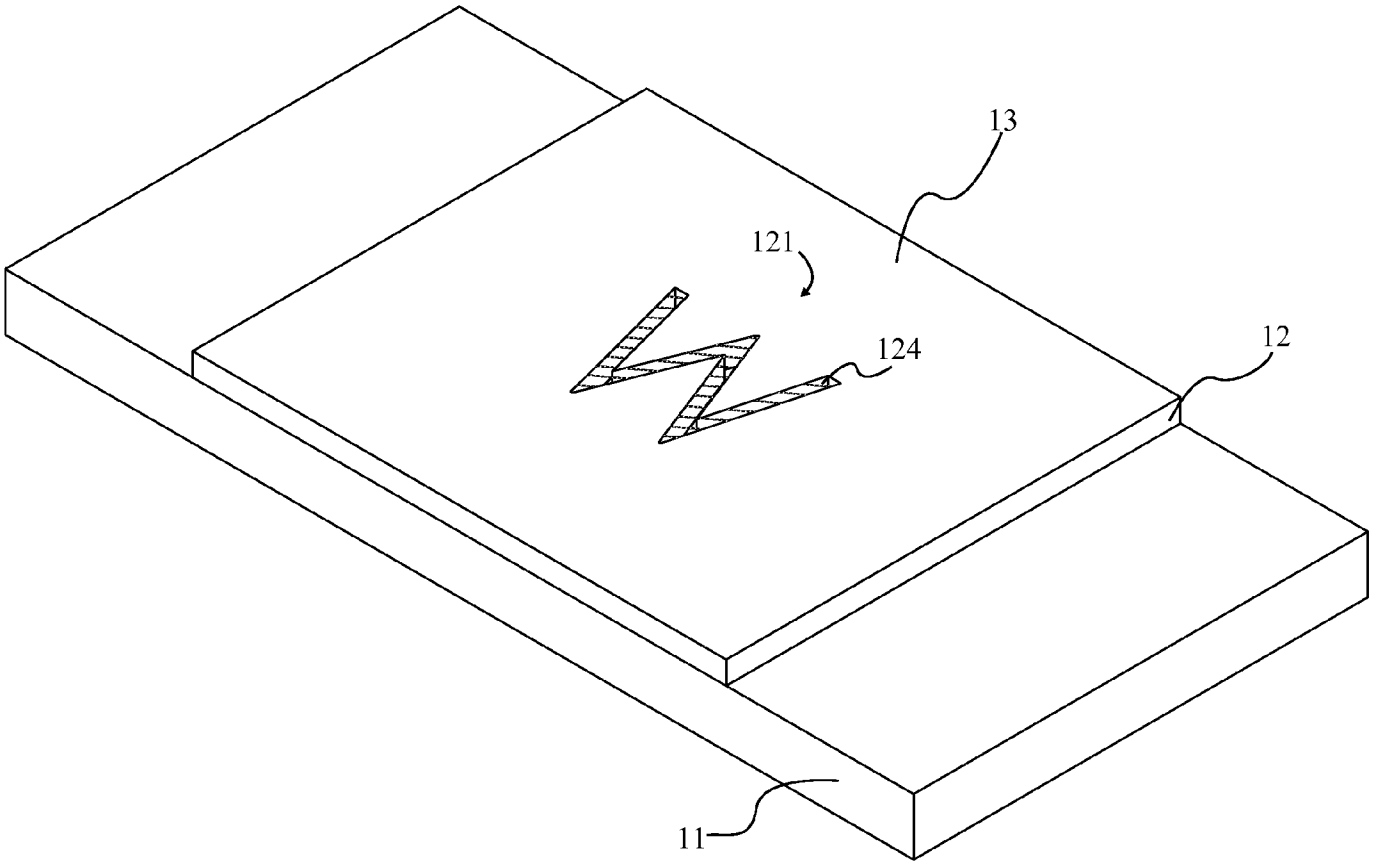
FIG. 32 is a perspective view showing a sixth blackout method of one embodiment of the present invention.
Figure 33:
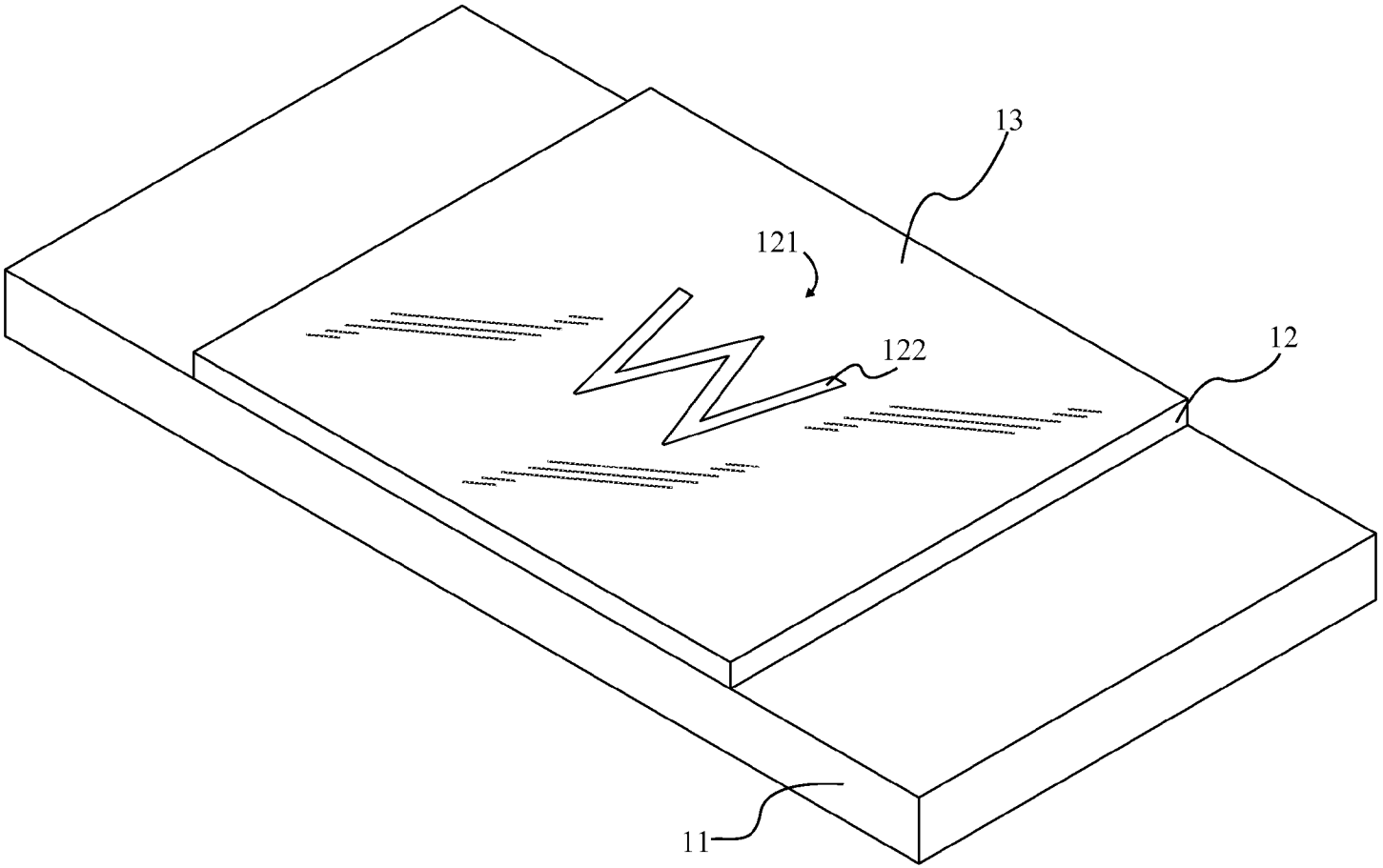
FIG. 33 is a perspective view showing a variation of the sixth blackout method of one embodiment of the present invention.

In a sixth blackout method, shown in FIG. 32, the designs are implemented by means of the plurality of translucent sections 124 of the outsole 12. The outsole 12 is molded so that the plurality of translucent sections 124 is integrated into the outsole 12; the translucent sections 124 are made from a clear or translucent material rather than an opaque material like the rest of the outsole 12. This blackout method requires the use of a multicolor mold in order to create the plurality of translucent sections 124 in the opaque outsole 12. This effectively allows light from the internally illuminated translucent midsole 11 to pass through the translucent sections 124 within the opaque outsole 12, similar to the other blackout methods. This blackout method can also be used with translucent outsoles 12, substituting opaque sections 122 for the translucent sections 124 in order to create "negative space" designs such as shown in FIG. 33. Said designs are defined by the opaque sections 122 while the translucent portion of the outsole 12 creates the negative space. This "negative space" design is conceptually similar to writing black letters on a white background instead of writing white letters on a black background. When this blackout method is applied to a translucent outsole 12, the outsole 12 is internally illuminated through the translucent midsole 11, but the designs are defined by the opaque sections 122 of the outsole 12.

Figure 34:
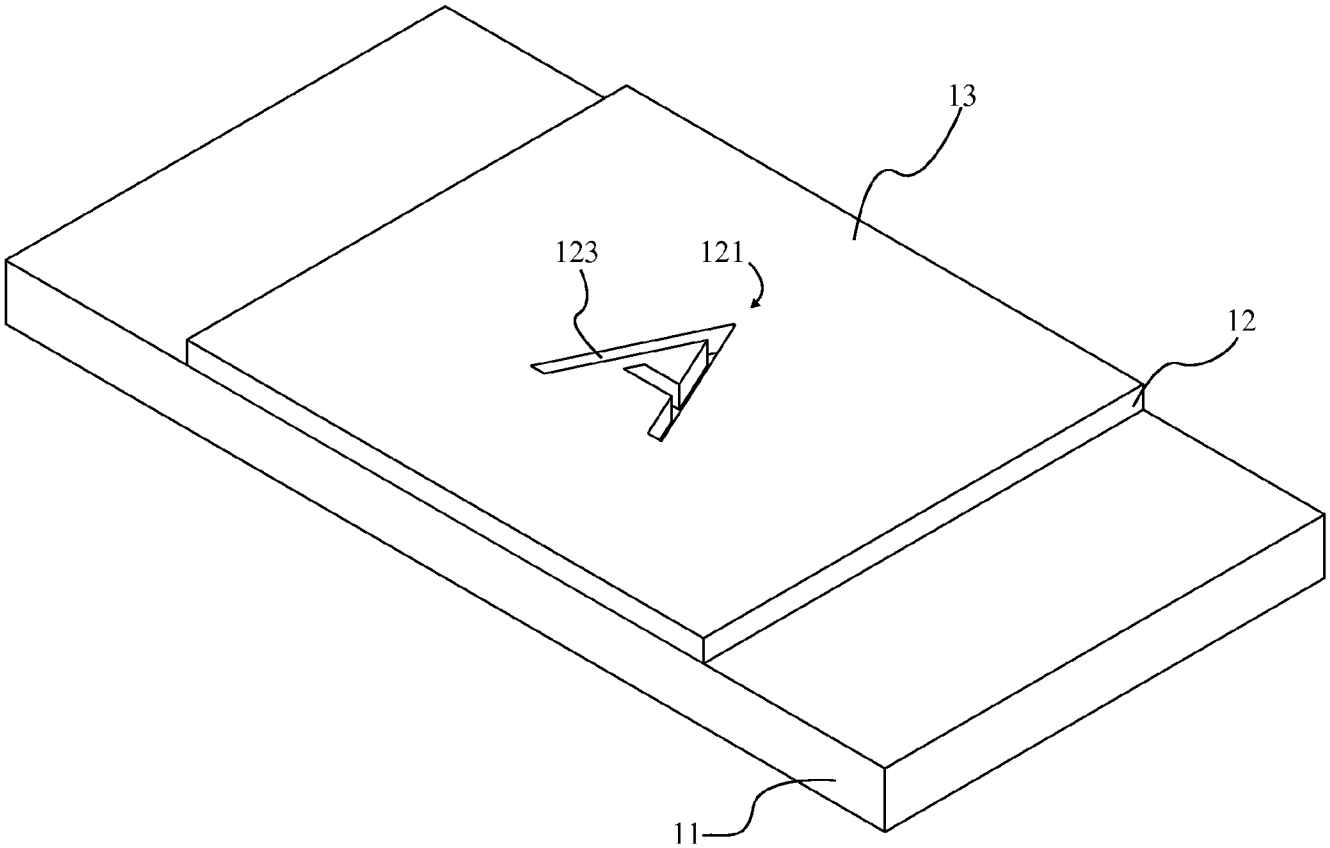
FIG. 34 is a perspective view showing a seventh blackout method of one embodiment of the present invention.

In a seventh blackout method, the plurality of cavities 123 are made in a stencil style, as seen in FIG. 34; this is similar to the second blackout method in that it aims to address designs with internal outlines, e.g. the letter "A". These areas, or "islands" as known in stenciling, are spaces that are surrounded by pieces that need to be cut. The triangle shape in the "A" is one such example. Stencils solves this problem by adding bridges to the designs. These bridges connect islands to other parts of the stencil, allowing the stencil to remain as one piece while still having the full design show up.

The various blackout methods can be applied anywhere along the sole section 1. It is even possible to blackout illumination from the side of the translucent midsole 11 or sole section 1, whether through a multicolor mold or by extending the opaque outsole 12 to cover parts or all of the side of the translucent midsole 11. Resultantly, designs, logos, and other arrangements could be incorporated across the sides of the sole section 1 and translucent midsole 11, an example of which can be seen in FIG. 8.

In addition to the mentioned embodiments there are a multitude of slight variations that could be made to the present invention. In another example, the outsole 12 does not need to completely cover the translucent midsole 11. Parts of the translucent midsole 11 could be incorporated as part of the sole, where sections of the translucent midsole 11 protrude from the rest of the midsole and form a flush bottom surface 13 with the outsole 12. Examples of this are visible in FIG. 17, FIG. 19, FIG. 23, and FIG. 25.

Potentially, the translucent midsole 11 could be hollowed out and designed to fill with water, providing an alternative visual experience. However, this would require sealing the translucent midsole 11 from the illumination housing 3, as well as providing a way to fill the translucent midsole 11 with water. A simpler change is placing a dispersive prism facing the illumination source, refracting the light and further enhancing the visual experience.

Figure 9:
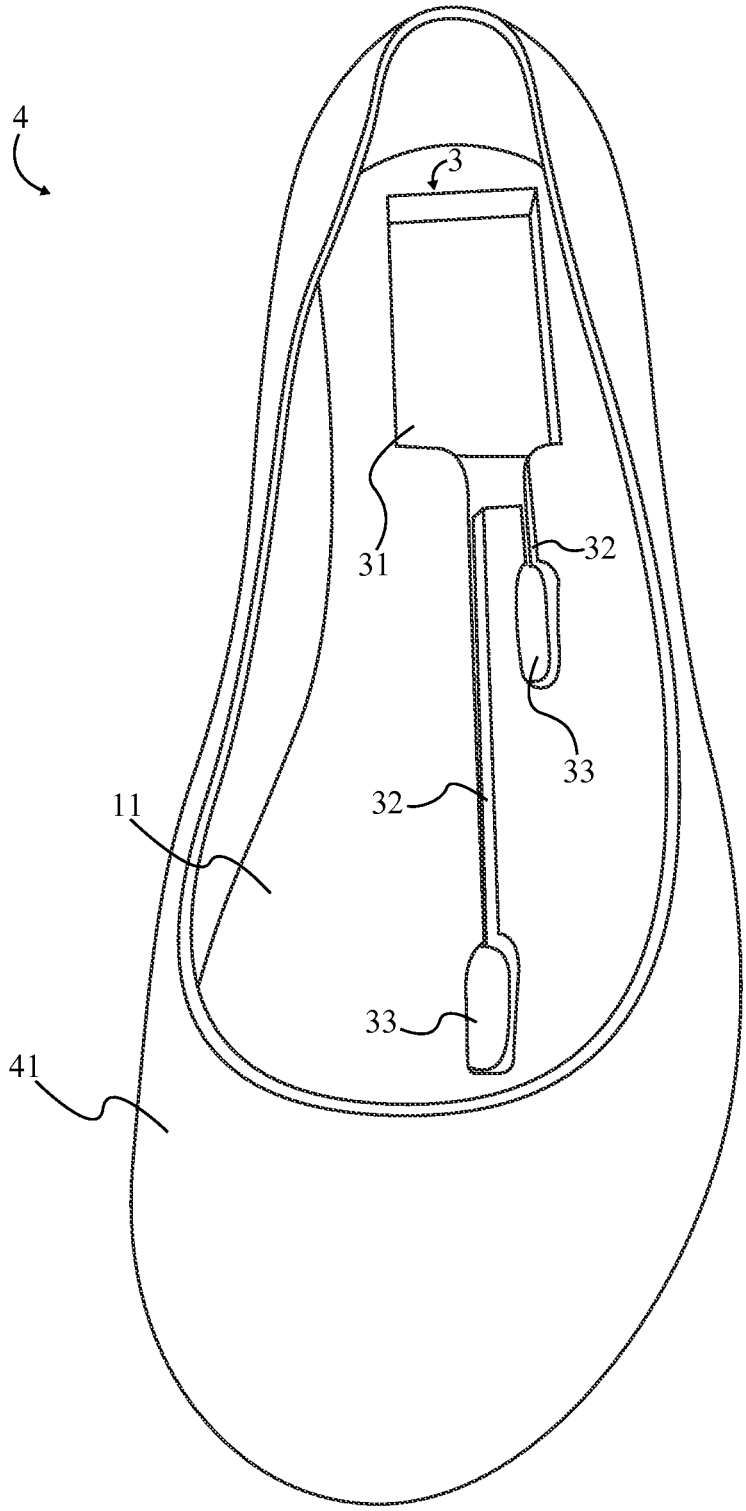
FIG. 9 is a top perspective view of an singularly molded translucent footwear embodiment of the present invention.
Figure 10:
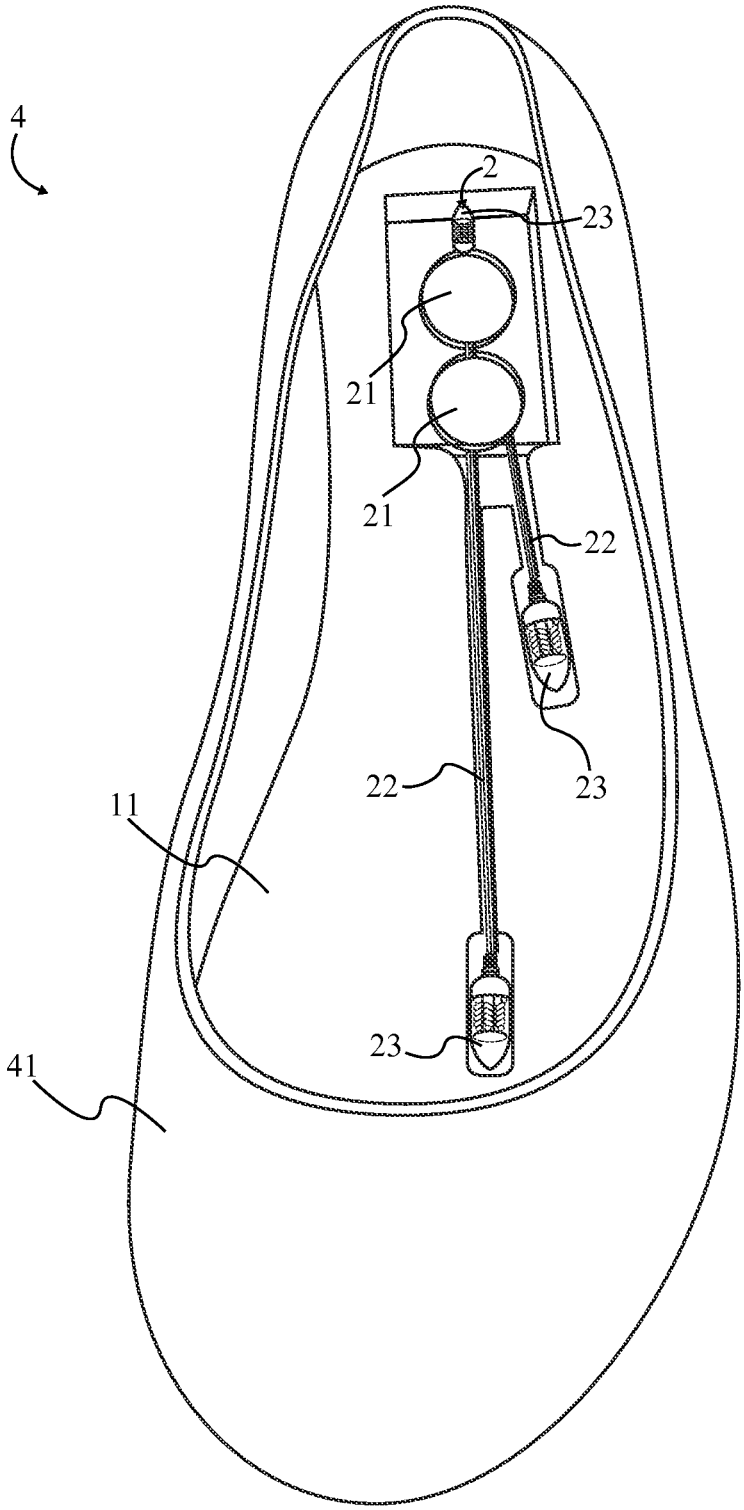
FIG. 10 is a top perspective view showing the illumination system of the singularly molded translucent footwear embodiment of the present invention.
Figure 11:
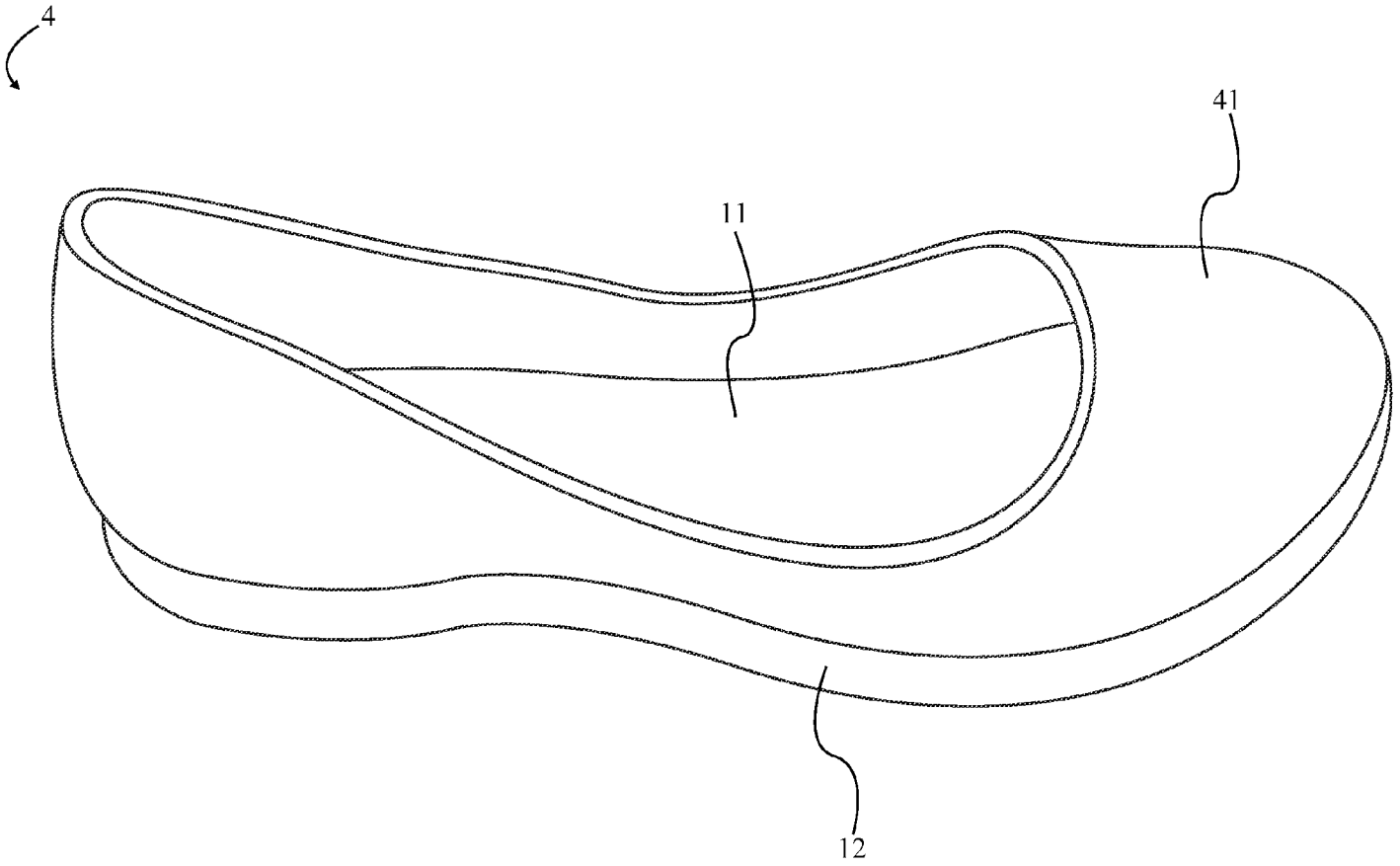
FIG. 11 is an elevated side view showing the singularly molded translucent footwear embodiment of the present invention.

Revisiting and recapping the earlier described jelly embodiment, the jelly footwear 4 can be integrally molded from a translucent midsole 11, a translucent outsole 12, and a translucent upper 41. The translucent midsole 11 and the translucent outsole 12 combine to serve as a translucent sole section 1 of the footwear. An illumination system 2 is installed in illumination housing 3 of the translucent sole section 1. The primary difference between the jelly footwear 4 embodiment and other embodiments is the aforementioned integral molding of sole section 1 components and translucent upper 41, as well as the entire jelly footwear 4 being translucent. As a result, the full jelly footwear 4 is internally illuminated, as compared to some of the other embodiments which have opaque (and thus non-illuminated) outsoles 12, uppers 41, or both. Additionally, the jelly footwear 4 embodiment can incorporate a tread pattern 15 into a bottom surface 13 of the sole section 1 (whether only the translucent outsole 12 or a combination of the translucent outsole 12 and translucent midsole 11). This jelly footwear 4 is illustrated in FIG. 9, FIG. 10, and FIG. 11.

Although the invention has been explained in relation to its preferred embodiment, it is to be understood that many other possible modifications and variations can be made without departing from the spirit and scope of the invention as hereinafter claimed.

What is claimed is:

1. An internally illuminated footwear component comprises:

a translucent sole section;

a translucent upper;

the translucent sole section comprises a translucent midsole and a translucent outsole;

the translucent midsole, the translucent outsole, and the translucent upper being integrally molded to form a translucent footwear;

the translucent sole section comprises a translucent tread pattern along a bottom surface;

an illumination system;

the illumination system comprises a power source, a plurality of electrical wires, and a plurality of illumination sources;

an illumination housing;

the power source being electrically connected to the plurality of illumination sources;

the illumination housing being positioned internally within the translucent sole section;

the illumination system being located within the illumination housing, wherein the plurality of illumination sources internally illuminates the translucent sole section and the translucent upper; and the illumination system being permanently encapsulated internally within the translucent sole section.

2. The internally illuminated footwear component as claimed in claim 1 comprises:

the illumination housing comprises a power section, a plurality of channels, and a plurality of illumination sections;

the power source being positioned within the power section;

the plurality of illumination sources being positioned within the plurality of illumination sections;

the plurality of electrical wires being positioned in the plurality of channels;

the plurality of channels traversing from the power section to the plurality of illumination sections; and the power source being electrically connected to the plurality of illumination sources through the plurality of electrical wires.

3. The internally illuminated footwear component as claimed in claim 1 comprises:

the translucent midsole and the translucent outsole being integrally molded to form the translucent sole section.

4. The internally illuminated footwear component as claimed in claim 1 comprises:

the translucent outsole comprises a plurality of outsole design sections;

the plurality of outsole design sections being a plurality of opaque sections;

the plurality of opaque sections traversing through the translucent outsole.

5. The internally illuminated footwear component as claimed in claim 1 comprises:

the translucent outsole partially or completely laterally enclosing the translucent midsole;

the translucent outsole comprises a plurality of outsole design sections; and the plurality of outsole design sections being positioned into the translucent outsole, wherein designs may be incorporated into a side surface of the footwear.

6. The internally illuminated footwear component as claimed in claim 1 comprises:

the translucent midsole forming part of a bottom surface of the translucent sole section, wherein sections of the translucent midsole are flush with the translucent outsole.

* * * * *